US011189897B2

(12) United States Patent
Uemichi

(10) Patent No.: US 11,189,897 B2
(45) **Date of Patent: *Nov. 30, 2021**

(54) FILTER

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 139 days.

This patent is subject to a terminal disclaimer.

(21) Appl. No.: 16/605,935

(22) PCT Filed: Apr. 23, 2018

(86) PCT No.: PCT/JP2018/016486
§ 371 (c)(1),
(2) Date: Oct. 17, 2019

(87) PCT Pub. No.: WO2018/199036
PCT Pub. Date: Nov. 1, 2018

(65) Prior Publication Data

US 2021/0126332 A1 Apr. 29, 2021

(30) Foreign Application Priority Data

Apr. 28, 2017 (JP) ..... JP2017-090621
Jul. 19, 2017 (JP) ..... JP2017-139717

(51) Int. Cl.
*H01P 1/207* (2006.01)
*H01P 1/208* (2006.01)

(52) U.S. Cl.
CPC ..... *H01P 1/2088* (2013.01)

(58) Field of Classification Search
CPC ..... H01P 1/207; H01P 1/208
See application file for complete search history.

(56) References Cited

U.S. PATENT DOCUMENTS 4,677,402 A * 6/1987 Cesani ..... H01P 1/205 333/203
4,902,992 A 2/1990 Rubin et al.
(Continued)

FOREIGN PATENT DOCUMENTS

CN 102723543 A 10/2012
CN 103531868 A 1/2014
(Continued)

OTHER PUBLICATIONS

Lee, Boyoung et al., "K-Band Frequency Tunable Substrate-Integrated-Waveguide Resonator Filter with Enhanced Stopband Attenuation", IEEE, Transactions on microwave theory and techniques, Nov. 2015, vol. 63, No. 11, pp. 3632-3640, XP011588890; Cited in EP Search Report dated Nov. 18, 2020.
(Continued)

*Primary Examiner* — Dean O Takaoka
(74) *Attorney, Agent, or Firm* — Westerman, Hattori, Daniels & Adrian, LLP

(57) ABSTRACT

Designing a filter with desired characteristics is made easy. A filter (1) includes a plurality of resonators (10 to 50) which are electromagnetically coupled. The plurality of resonators (10 to 50) each have a broad wall (11, 12, 21, 22, 31, 32, 41, 42, 51, 52) that is in a shape of a circle or a regular polygon with six or more vertices, and two resonators, which are coupled together, of the plurality of resonators (10 to 50) are arranged such that $D<R_1+R_2$ is satisfied, where $R_1$ and $R_2$ represent radii of circumcircles of the broad walls of the two resonators and D represents a center-to-center distance between the two resonators.

11 Claims, 14 Drawing Sheets

(56) References Cited

U.S. PATENT DOCUMENTS 5,894,250 A * 4/1999 Ravaska ..... H01P 1/2136 333/134
9,564,672 B2 * 2/2017 Burke ..... H01P 11/008

FOREIGN PATENT DOCUMENTS

| | | | |
|---|---|---|---|
| CN | 105048051 | A | 11/2015 |
| CN | 106159387 | A | 11/2016 |
| CN | 106207323 | A | 12/2016 |
| CN | 106450609 | A | 2/2017 |
| FR | 2 346 868 | A1 | 10/1977 |
| JP | H11-239006 | A | 8/1999 |
| JP | 2004-247843 | A | 9/2004 |
| JP | 2014-179935 | A | 9/2014 |
| JP | 6042014 | B1 | 12/2016 |

OTHER PUBLICATIONS

Duong, T. V. et al., "A New Class of Selectivity-improved Mm-waves Dual-mode Substrate Integrated Waveguide Filters", IEEE, pp. 1-3, XP032868394; Cited in EP Search Report dated Nov. 18, 2020.

Potelon, Benjamin et al., "Design of a Substrate Integrated Waveguide(SIW) Filter Using a Novel Topology of Coupling", IEEE, Microwave and Wireless Components Letters, Sep. 2008, vol. 18, No. 9, pp. 596-598, XP011234474; Cited in EP Search Report dated Nov. 18, 2020.

Oncu, Emrah et al., "A Compact Filter using Substrate Integrated Waveguide Technology", IEEE, 2013, p. 527-530, XP032477212; Cited in EP Search Report dated Nov. 18, 2020.

Sirci, Stefano et al., "Substrate Integrated Waveguide Diplexer Based on Circular Triplet Combline Filters", IEEE, Microwave and Wireless Components Letters, vol. 25, No. 7, Jul. 2015, pp. 430-432, XP011662379; Cited in EP Search Report dated Dec. 4, 2020.

Duong, Tuan-Viet et al., "A Millimeter Wave High-Isolation Diplexer Using Selectivity-Improved Dual-Mode Filters", IEEE, Microwave and Wireless Components Letters, vol. 26, No. 2, Feb. 2016, pp. 104-106, XP011598429; Cited in EP Search Report dated Dec. 4, 2020.

Non-Final Office Action dated Feb. 5, 2021, issued in U.S. Appl. No. 16/607,480 (27 pages).

Aitken, J. R. et al., "Design of millimetre wave diplexers with relaxed fabrication tolerances", IET Microwaves, Antennas & Propagation, Jun. 1, 2015, vol. 9, iss . 8, pp. 802-807, IET The Institution of Engineering and Technology. (7 pages).

Cheng, Y. L. et al., "A W-band Quadrature Hybrid Coupled Substrate Integrated Waveguide Diplexer", 2015 Asia-Pacific Microwave Conference, Feb. 2016 (3 pages).

International Search Report dated May 22, 2018, issued in counterpart application No. PCT/JP2018/016470 (Form PCT/ISA/210) (3 pages).

International Preliminary Report on Patentability (Forms PCT/IB/338; PCT/IB/373; PCT/ISA/237) for PCT/JP2018/016470 dated Nov. 7, 2019. (18 pages).

Yusuke Uemichi, et. al, "Compact and Low-Loss Bandpass Filter Realized in Silica-Based Post-Wall Waveguide for 60-Ghz applications", Optics and Electronics Laboratory, Fujikura Ltd., Sakura, Chiba, 285-8550, Japan, Graduate School of Advanced Sciences of Matter, Hiroshima University 1-3-1 Kagamiyama, Higashihiroshima 739-8530, Japan (3 pages).

Notification of Transmittal of Translation of the International Preliminary Report on Patentability (Form PCT/IB/338) of International Application No. PCT/JP2018/06486 dated Nov. 7, 2019 with Forms PCT/IB/373, PCT/ISA/237 (17 pages).

Chongder, Prasun et al., "Design of Dual-Mode Substrate Integrated Hexagonal Cavity (SIHX) Filter for X-Band Application", Microwave Conference Proceedings (APMC), 2013 Asia-Pacific, 2013, pp. 942-944 (4 pages).

Yin, Jun-Xiang et al., "A Triple Cylindrical Cavity W-BAND Filter Implemented in Substrate Integrated Waveguide (SIW)", Microwave, Antenna, Propagation, and EMC Technologies (MAPE), 2015 IEEE 6th International Symposium, 2015, pp. 564-566. (4 pages).

Potelon, Benjamin, et al., "Design of Ku-Band Filter based on Substrate-Integrated Circular Cavities (SICCs)", Microwave Symposium Digest, 2006, IEEE MTT-S International, pp. 1237-1240. (4 pages).

International Search Report dated May 15, 2018, issued in counterpart application No. PCT/JP2018/06486 (3 pages).

Related co-pending U.S. Appl. No. 16/607,480.

* cited by examiner

FILTER

TECHNICAL FIELD

The present invention relates to a resonator-coupled filter.

BACKGROUND ART

A band-pass filter (BPF) designed for use in microwave and millimeter-wave bands is disclosed in, for example, Patent Literature 1, Non-patent Literature 1, and the like.

Such a BPF is produced by using a post-wall waveguide (PWW) technique. Specifically, such a BPF is produced with use of a substrate made of a dielectric material sandwiched between a pair of conductor layers. The substrate has therein a plurality of resonators coupled together. Each of these resonators is formed by: the pair of conductor layers serving as a pair of broad walls; and a post wall(s), which is/are constituted by a plurality of conductor posts in a palisade arrangement, serving as a narrow wall(s).

Two adjacent resonators of a plurality of resonators are partitioned by a post wall, a part of which has a waveguide aperture formed by several missing conductor posts. The two adjacent resonators are electromagnetically coupled together via this waveguide aperture. The plurality of resonators include a first-pole resonator that has an input port and a last-pole resonator that has an output port, and the first and last-pole resonators have such electromagnetically coupled one or more resonators therebetween. As such, a BPF that employs a PWW technique is a resonator-coupled BPF.

The BPF disclosed in FIG. 2 of Patent Literature 1 is a three-pole filter that is constituted by three resonators. In this BPF, each of the resonators is in the shape of a baseball home plate (a pentagon). In this arrangement, the resonators are equally displaced from one another by an angle of 120° such that they have a three-fold rotational symmetry.

Furthermore, the BPFs disclosed in FIG. 5 of Non-patent Literature 1 are each a multi-pole filter (three-pole or five-pole filter) constituted by three or five resonators. In such BPFs, the shape of each of the resonators is rectangle. In this arrangement, the resonators in the respective poles are arranged in a straight line.

CITATION LIST

Patent Literature

[Patent Literature 1]
Japanese Patent Application Publication, Tokukai, No. 2004-247843 (Publication date: Sep. 2, 2004)

Non-Patent Literature

[Non-Patent Literature 1]
Yusuke Uemichi, et al, Compact and Low-Loss Bandpass Filter Realized in Silica-Based Post-Wall Waveguide for 60-GHz applications, IEEE MTT-S IMS, May 2015.

SUMMARY OF INVENTION

Technical Problem

In designing a BPF disclosed in Patent Literature 1, Non-patent Literature 1, or the like, the number of resonators constituting the BPF is set according to the desired filter characteristics. Then, for the purpose of obtaining the desired filter characteristics, a plurality of design parameters concerning the shape of each resonator and the arrangement of the resonators are optimized. Operations to optimize the plurality of design parameters require much experience and much effort.

The present invention was made in view of the above issue, and an object thereof is to reduce the number of design parameters and thereby make it easy to design a filter with desired characteristics.

Solution to Problem

In order to attain the above object, a filter in accordance with an aspect of the present invention is a filter including a plurality of resonators which are electromagnetically coupled, the plurality of resonators each having a broad wall that is in a shape of a circle or a regular polygon with six or more vertices, two resonators, which are coupled together, of the plurality of resonators being arranged such that $D<R_1+R_2$ is satisfied, where $R_1$ and $R_2$ represent radii of circumcircles of the broad walls of the two resonators and D represents a center-to-center distance between the two resonators.

Advantageous Effects of Invention

A filter in accordance with an aspect of the present invention makes it easy to design a filter with desired characteristics.

BRIEF DESCRIPTION OF DRAWINGS (a) of FIG. 1 is a perspective view illustrating a filter in accordance with Embodiment 1 of the present invention. (b) of FIG. 1 is a plan view of the filter illustrated in (a) of FIG. 1.

(a) to (d) of FIG. 2 are plan views of respective filters in accordance with Variations 1 to 4 of the present invention.

(a) and (b) of FIG. 3 are plan views of respective filters in accordance with Variations 5 and 6 of the present invention.

FIG. 4 is a perspective view illustrating an example of a configuration in which the filter illustrated in FIG. 1 is arranged using a post-wall waveguide technique.

(a) and (b) of FIG. 5 are a plan view and a cross-sectional view of a converter, respectively. The converter is capable of being provided at an end of a waveguide connected to an input port of the filter illustrated in FIG. 4.

(a) of FIG. 6 is a perspective view illustrating a filter in accordance with Embodiment 2 of the present invention. (b) of FIG. 6 is a plan view of the filter illustrated in (a) of FIG. 6.

Figure 8:
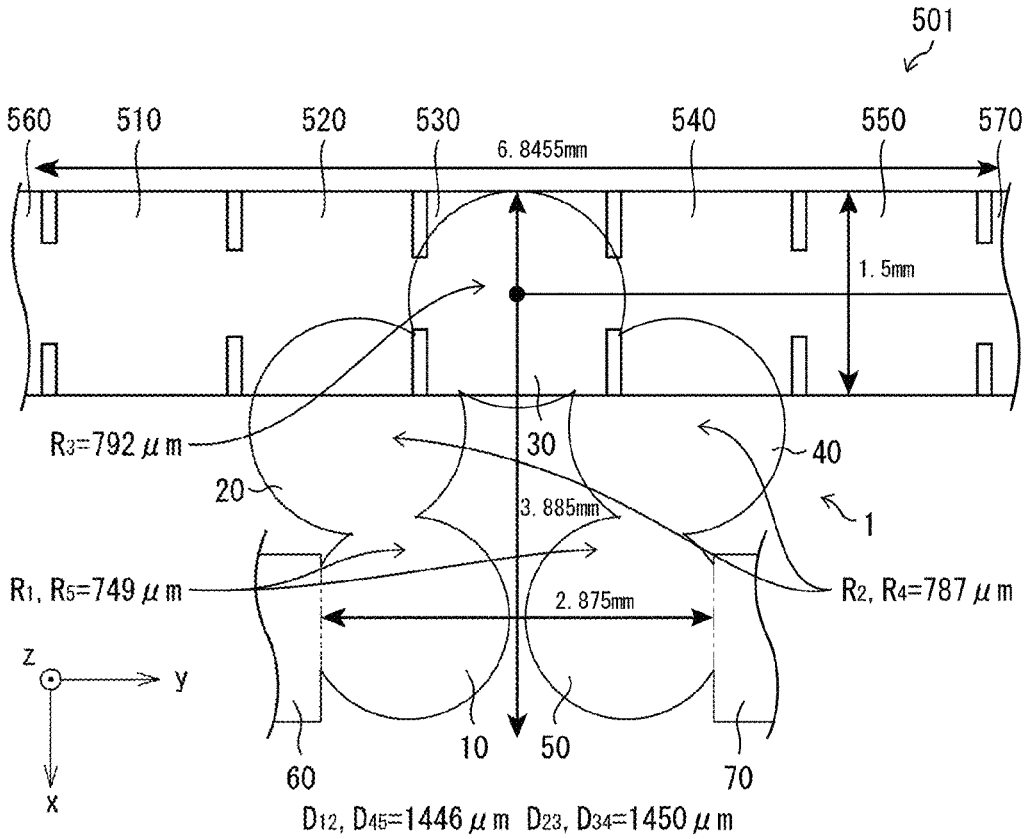
FIG. 8 is a plan view illustrating a filter which is an Example of the present invention and a filter which is a Comparative Example of the present invention.
Figure 9:
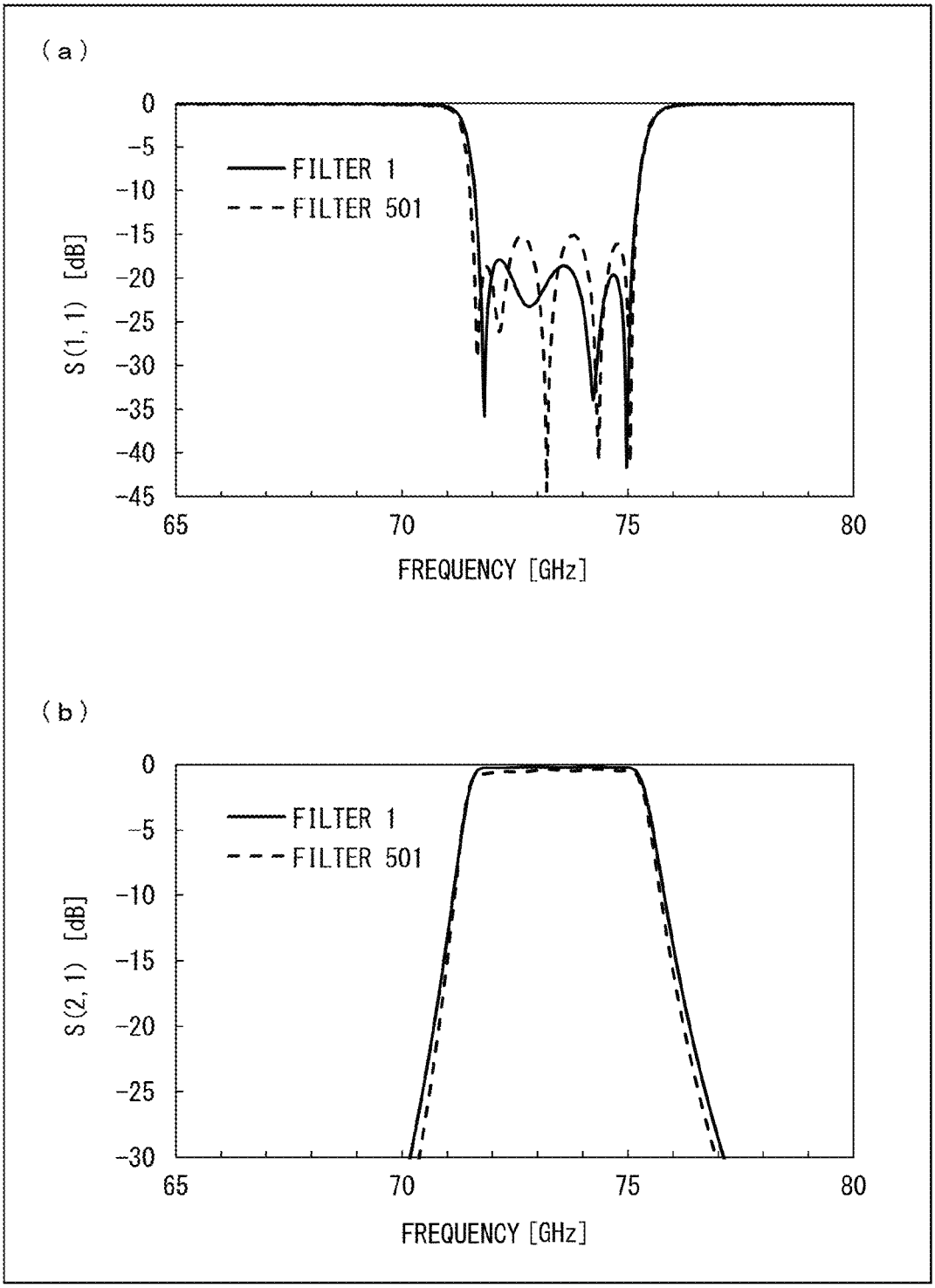

(a) of FIG. 9 is a chart showing reflection characteristics of the filter of the Example and the filter of the Comparative Example illustrated in FIG. 8. (b) of FIG. 9 is a chart showing transmission characteristics of the filter of the Example and the filter of the Comparative Example illustrated in FIG. 8.

Figure 10:
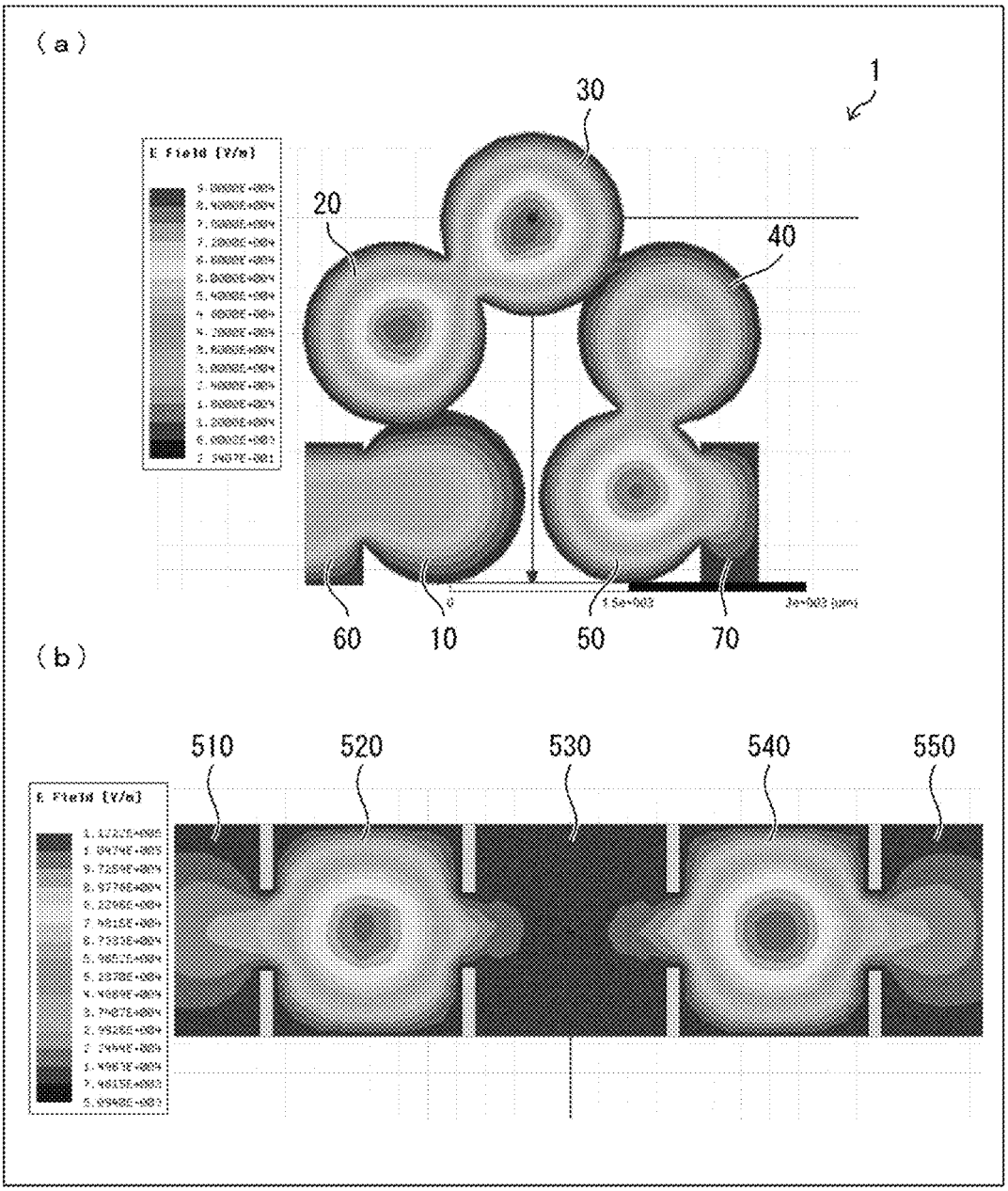

(a) of FIG. 10 is a contour diagram showing an electric field distribution in the filter of the Example illustrated in FIG. 8. (b) of FIG. 10 is a contour diagram showing an electric field distribution in the filter of the Comparative Example illustrated in FIG. 8.

Figure 11:
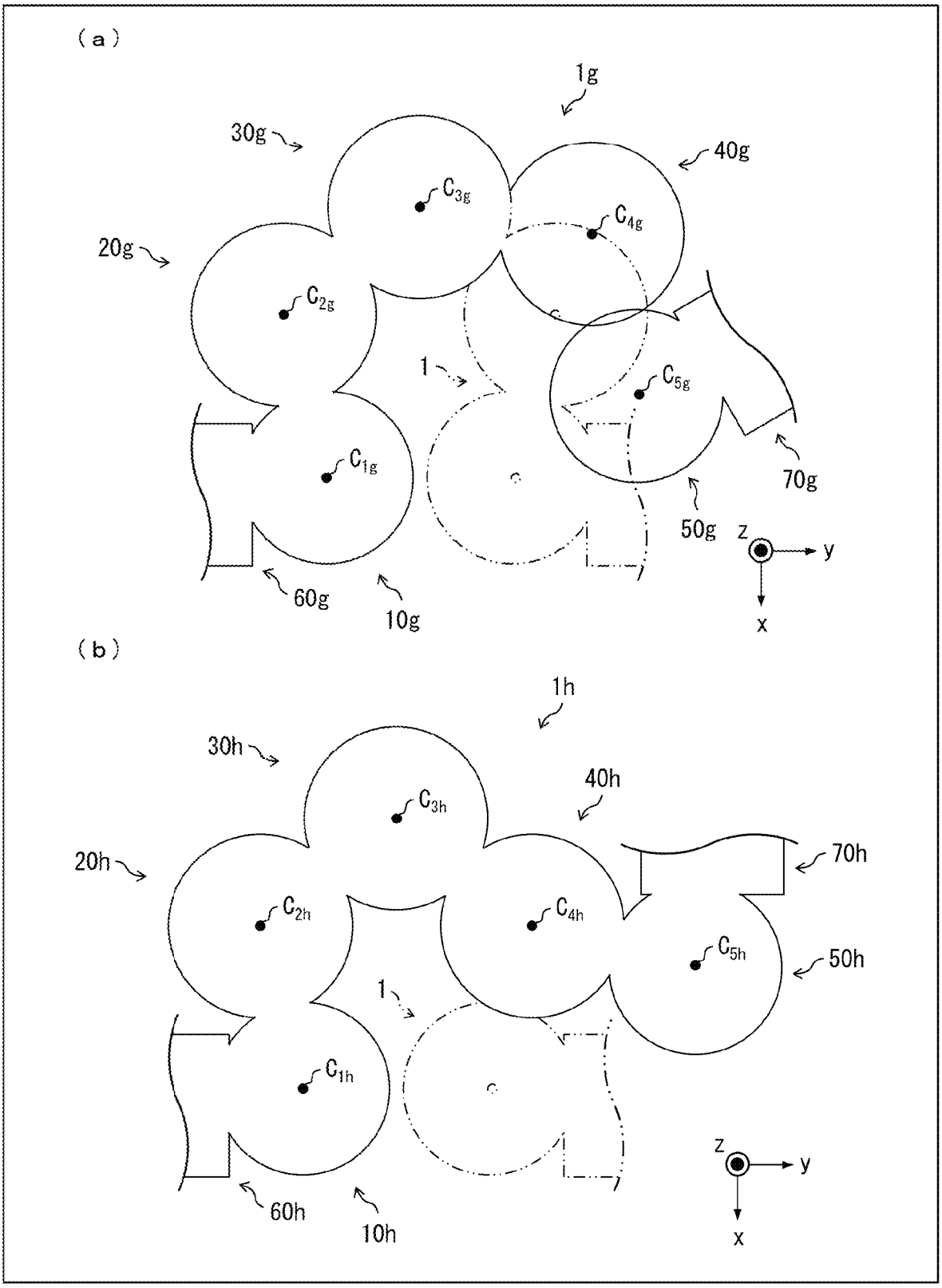

(a) and (b) of FIG. 11 are plan views of Variations 8 and 9 of the present invention.

Figure 12:
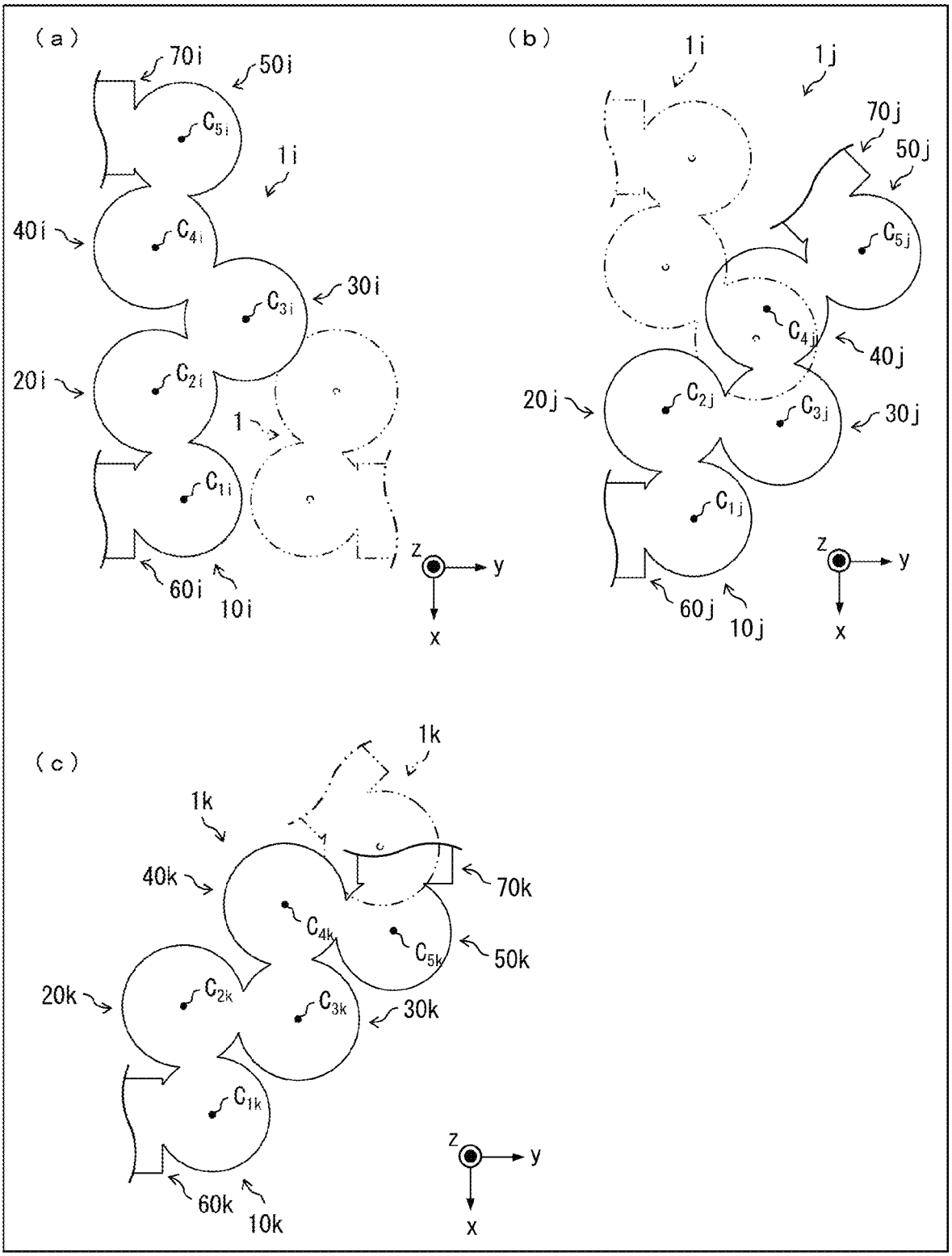

(a) to (c) of FIG. 12 are plan views of Variations 10 to 12 of the present invention.

Figure 13:
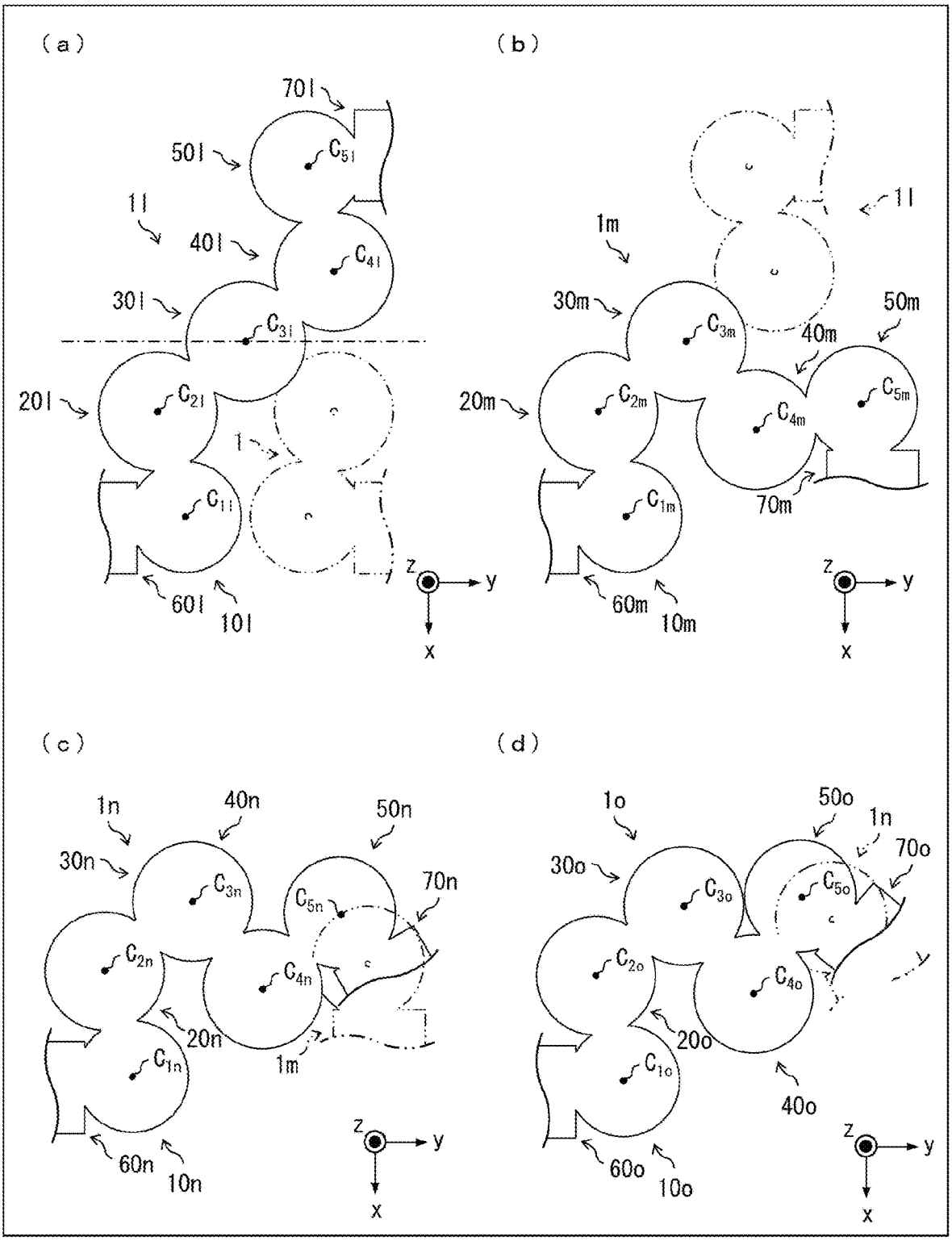

(a) to (d) of FIG. 13 are plan views of Variations 13 to 16 of the present invention.

Figure 14:
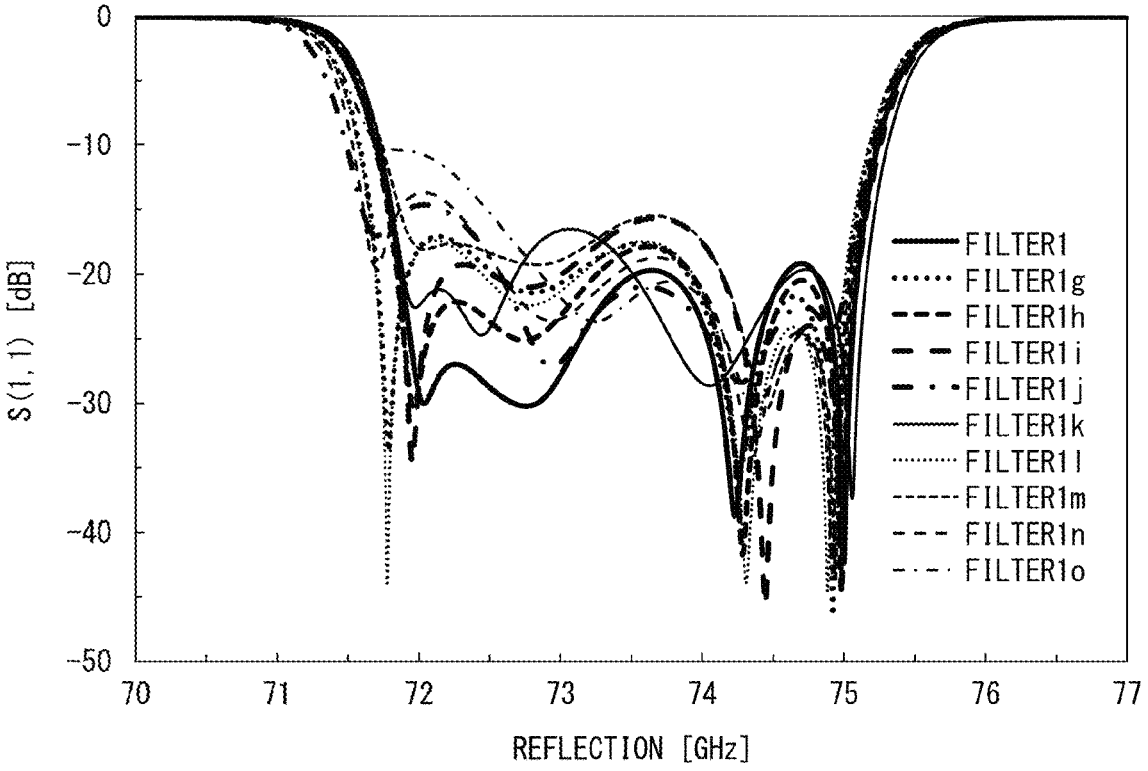

FIG. 14 is a chart showing reflection characteristics of the Example shown in FIG. 8 and Variations 8 to 16 of the present invention.

DESCRIPTION OF EMBODIMENTS

Embodiment 1

Figure 1:
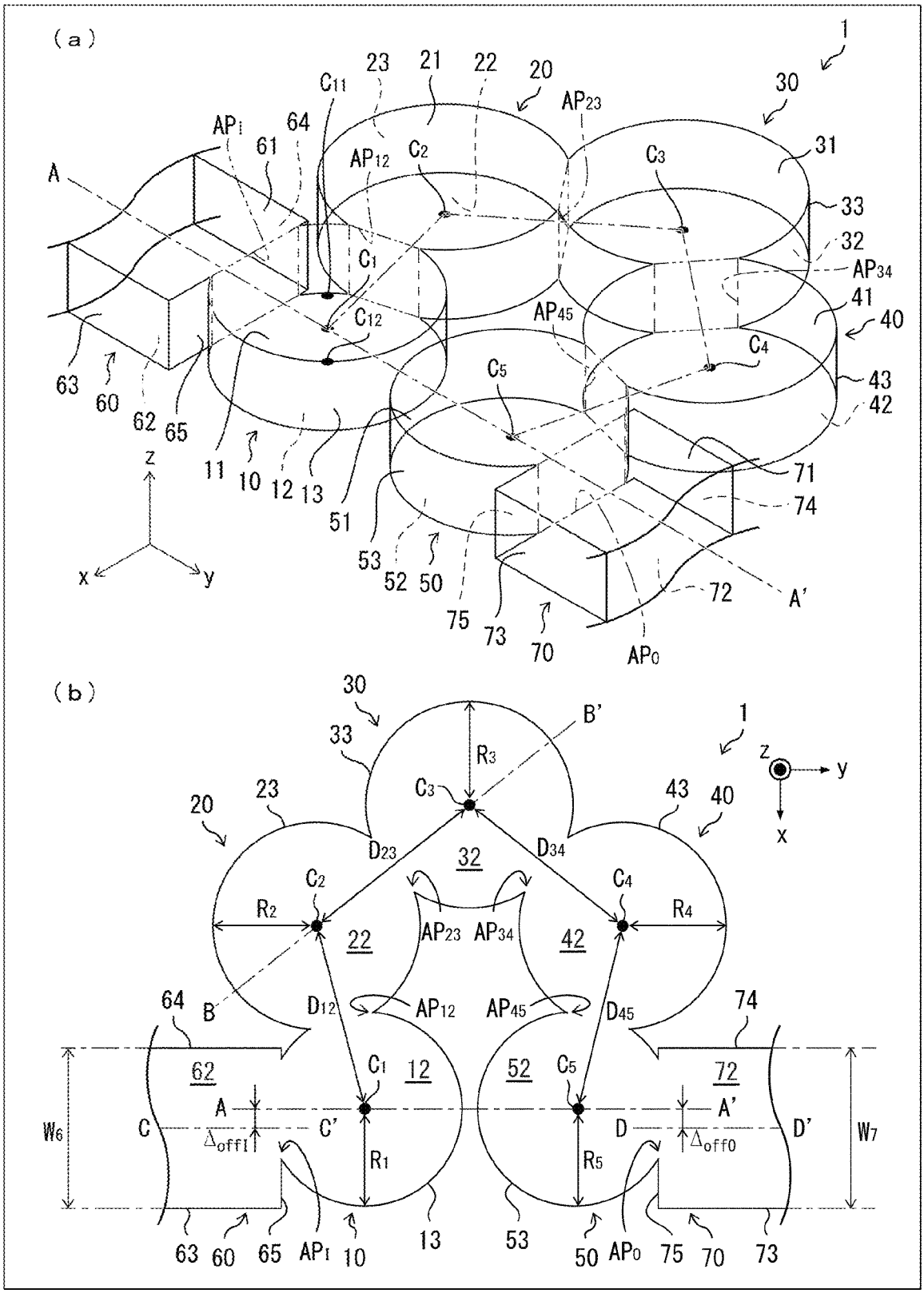

The following description will discuss a filter in accordance with Embodiment 1 of the present invention with reference to FIG. 1. (a) of FIG. 1 is a perspective view illustrating a filter 1 in accordance with Embodiment 1. (b) of FIG. 1 is a plan view of the filter 1. Note that, in the filter 1 illustrated in (b) of FIG. 1, one of each pair of opposite broad walls (broad walls 11, 21, 31, 41, 51, 61, and 71, each of which is the broad wall positioned downstream in the positive z axis direction) is not illustrated. This is for easy description of an arrangement of waveguide apertures $AP_{12}$, $AP_{23}$, $AP_{34}$, $AP_{45}$, $AP_I$, and $AP_O$.

Resonators 10 to 50

As illustrated in (a) and (b) of FIG. 1, the filter 1 includes: a resonator 10, a resonator 20, a resonator 30, a resonator 40, and a resonator 50; a waveguide 60; and a waveguide 70.

The resonator 10 is formed by: a pair of opposite broad walls 11 and 12; and a narrow wall 13 that resides between the broad wall 11 and the broad wall 12. The broad walls 11 and 12 are constituted by metal conductor layers. Each of the broad walls 11 and 12 is in the shape of a circle, except in the portions where the waveguide apertures $AP_I$ and $AP_{12}$ are located. The waveguide apertures $AP_I$ and $AP_{12}$ will be described later.

The narrow wall 13 is constituted by a metal conductor layer. The narrow wall 13 is in the shape of a rectangle when opened out. That is, the narrow wall 13 is a long narrow conductor. The resonator 10 is in a form such that the narrow wall 13, which is a long narrow conductor as described above, is bent along the contours of the broad walls 11 and 12 into a roll. The narrow wall 13 allows electrical communication between the broad wall 11 and the broad wall 12, and is combined with the broad wall 11 and the broad wall 12 to form a cylindrical space that is closed except for the waveguide apertures $AP_I$ and $AP_{12}$.

Each of the waveguide apertures $AP_I$ and $AP_{12}$ resembles a cut surface of a truncated cylinder (whose top and bottom faces are the broad walls 11 and 12) which is obtained by cutting off a part of the broad wall 11, a part of the broad wall 12, and a part of the narrow wall 13 in a direction intersecting (in Embodiment 1, in a direction perpendicular to) the broad walls 11 and 12. The waveguide aperture $AP_I$ allows electromagnetic coupling between the waveguide 60 (described later) and the resonator 10, whereas the waveguide aperture $AP_{12}$ allows electromagnetic coupling between the resonator 10 and a resonator 20 (described later).

Note that the thickness of this conductor layer can be set to any thickness depending on need. That is, the thickness of the conductor layer is not limited to a particular thickness, and the conductor layer may be any of general conductors in the form of a layer such as thin conductor films, conductor foil, and conductor plates.

Figure 4:
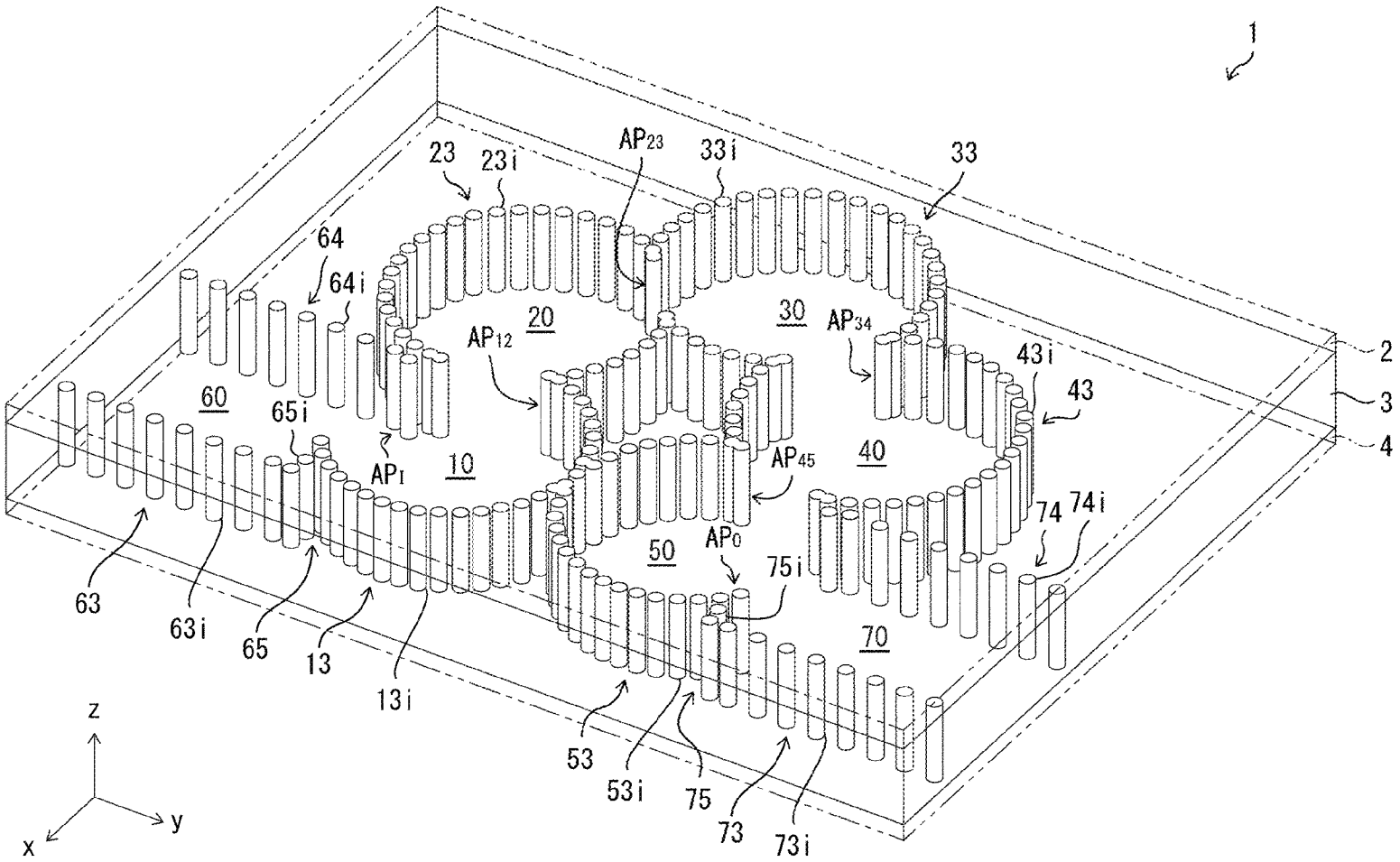

In Embodiment 1, the metal constituting the broad walls 11 and 12 and the narrow wall 13 is aluminum. Note that this metal is not limited to aluminum, and may be copper or an alloy composed of a plurality of metallic elements. Furthermore, although the narrow wall 13 in the filter 1 illustrated in FIG. 1 is constituted by a conductor layer, the narrow wall 13 may be constituted by a post wall as illustrated in FIG. 4.

Each of the resonators 20 to 50 is configured similarly to the resonator 10. Specifically, the resonator 20 is formed by: broad walls 21 and 22 which are a pair of board walls; and a narrow wall 23. The resonator 30 is formed by: broad walls 31 and 32 which are a pair of broad walls; and a narrow wall 33. The resonator 40 is formed by: broad walls 41 and 42 which are a pair of broad walls; and a narrow wall 43. The resonator 50 is formed by: broad walls 51 and 52 which are a pair of broad walls; and a narrow wall 53. Each of the broad walls 21 and 22 is in the shape of a circle except in the portions where the waveguide apertures $AP_{12}$ and $AP_{23}$ are located, each of the broad walls 31 and 32 is in the shape of a circle except in the portions where the waveguide apertures $AP_{23}$ and $AP_{34}$ are located, each of the broad walls 41 and 42 is in the shape of a circle except in the portions where the waveguide apertures $AP_{34}$ and $AP_{45}$ are located, and each of the broad walls 51 and 52 is in the shape of a circle except in the portions where the waveguide apertures $AP_{45}$ and $AP_O$ are located. The waveguide aperture $AP_{23}$ allows electromagnetic coupling between the resonator 20 and the resonator 30, the waveguide aperture $AP_{34}$ allows electromagnetic coupling between the resonator 30 and the resonator 40, the waveguide aperture $AP_{45}$ allows electromagnetic coupling between the resonator 40 and the resonator 50, and the waveguide aperture $AP_O$ allows electromagnetic coupling between the resonator 50 and the waveguide 70 (described later).

As has been described, the filter 1 is a five-pole, resonator-coupled filter in which the five resonators 10 to 50 are electromagnetically coupled. The filter 1 functions as a band-pass filter.

Waveguides 60 and 70

The waveguide 60 is a rectangular waveguide whose cross section is rectangle and which is formed by a pair of broad walls (broad walls 61 and 62) and a pair of narrow walls (narrow walls 63 and 64). The waveguide 60 has, at the resonator 10-side edge, a short wall 65 that has an opening equal in shape to the waveguide aperture $AP_I$ of the resonator 10. The waveguide 60 and the resonator 10 are connected such that this opening and the waveguide aperture $AP_I$ of the resonator 10 match each other, and thereby the waveguide 60 and the resonator 10 are electromagnetically coupled to each other.

Similarly to the waveguide 60, the waveguide 70 is a rectangular waveguide which is formed by a pair of broad walls (broad walls 71 and 72) and a pair of narrow walls (narrow walls 73 and 74). The waveguide 70 and the resonator 50 are connected such that an opening in a short wall 75 of the waveguide 70 and the waveguide aperture $AP_O$ of the resonator 50 match each other, and thereby the waveguide 70 and the resonator 50 are electromagnetically coupled to each other.

In the filter 1, each of the waveguide apertures $AP_I$ and $AP_O$ functions as an input-output port. When the waveguide aperture $AP_I$ serves as an input port, the waveguide aperture $AP_O$ serves as an output port, whereas, when the waveguide aperture $AP_O$ serves as an input port, the waveguide aperture $AP_I$ serves as an output port. Either of the input-output ports can be used as an input port; however, in the description of Embodiment 1, the waveguide aperture $AP_I$ serves as an input port and the waveguide aperture $AP_O$ serves as an output port. That is, the resonator 10 corresponds to the first-pole resonator recited in the claims, and the resonator 50 corresponds to the last-pole resonator recited in the claims.

Distance Between Centers of Resonators

As illustrated in (a) of FIG. 1, the center of the broad wall 11 is referred to as center $C_{11}$, and the center of the broad wall 12 is referred to as center $C_{12}$. Center $C_1$ of the resonator 10 resides at the midpoint between the center $C_{11}$ and the center $C_{12}$. Center $C_2$ of the resonator 20, center $C_3$ of the resonator 30, center $C_4$ of the resonator 40, and center $C_5$ of the resonator 50 are defined in a similar manner to the center $C_1$ of the resonator 10.

As illustrated in (b) of FIG. 1, the radius of the resonator 10 is referred to as $R_1$, the radius of the resonator 20 is referred to as $R_2$, the radius of the resonator 30 is referred to as $R_3$, the radius of the resonator 40 is referred to as $R_4$, and the radius of the resonator 50 is referred to as $R_5$. Furthermore, the distance (hereinafter referred to as center-to-center distance) between the center $C_1$ and the center $C_2$ is referred to as $D_{12}$, the center-to-center distance between the center $C_2$ and the center $C_3$ is referred to as $D_{23}$, the center-to-center distance between the center $C_3$ and the center $C_4$ is referred to as $D_{34}$, and the center-to-center distance between the center $C_4$ and the center $C_5$ is referred to as $D_{45}$. Note that the broad walls 11, 12, 21, 22, 31, 32, 41, 42, 51, and 52 of the resonators 10 to 50 are each in a circular shape. As such, the radii of the circumcircles of the broad walls 11, 12, 21, 22, 31, 32, 41, 42, 51, and 52 are equal to the radii $R_1$ to $R_5$ of the resonators 10 to 50, respectively.

In the above arrangement, the radius $R_1$, the radius $R_2$, and the center-to-center distance $D_{12}$ satisfy the condition $D_{12}<R_1+R_2$, the radius $R_2$, the radius $R_3$, and the center-to-center distance $D_{23}$ satisfy the condition $D_{23}<R_2+R_3$, the radius $R_3$, the radius $R_4$, the center-to-center distance $D_{34}$ satisfy the condition $D_{34}<R_3+R_4$, and the radius $R_4$, the radius $R_5$, and the center-to-center distance $D_{45}$ satisfy the condition $D_{45}<R_4+R_5$. Provided that such a condition is satisfied, two cylindrical resonators (for example, the resonator 10 and the resonator 20) can be coupled to each other via a waveguide aperture in the side walls of the resonators (for example, via the waveguide aperture $AP_{12}$).

Symmetry of Two Adjacent Resonators

Of the plurality of resonators in the filter 1, a focus is placed on two adjacent resonators coupled to each other. The following description is based on the resonator 20 and the resonator 30. The shape of a combination of the broad wall 21 or 22 and the broad wall 31 or 32 (equal to the shape of a combination of the circumcircles of the resonators 20 and 30) of the two resonators 20 and 30 is symmetric with respect to line BB' that connects the centers $C_2$ and $C_3$ of the two circumcircles together (see (b) of FIG. 1). As such, the degree of symmetry of the two resonators coupled to each other in the filter 1 is higher than that of the conventional filter (filter illustrated in FIGS. 1 and 2 of Patent Literature 1). This makes it possible to reduce the number of design parameters. Thus, the filter 1 makes it possible to easily design a filter with desired characteristics as compared to the conventional filter.

Note that, in the filter 1, not only two resonators coupled to each other but also the filter 1 as a whole is symmetric with respect to a line. Specifically, the resonators 10 to 50 are arranged such that they are symmetric with respect to a line that is parallel to the x axis and that passes through the center $C_3$ of the resonator 30, and the waveguides 60 to 70 are arranged such that they are symmetric with respect to that line. As such, the filter 1 has a high degree of symmetry also concerning the shape of the filter 1 as a whole. This makes it possible to further reduce the number of design parameters. Thus, the filter 1 makes it possible to more easily design a filter with desired characteristics as compared to the conventional filter.

Arrangement of Resonators 10 and 50

In the filter 1, the resonator 10 and the resonator 50 are arranged so as to be adjacent to each other (see (a) and (b) of FIG. 1). Therefore, the total length of the filter can be reduced as compared to when a plurality of resonators are arranged in a straight line. A reduction in total length of the filter makes it possible to reduce the absolute value of thermal expansion or thermal contraction that would result from a change in ambient temperature around the filter 1. As such, the filter 1, whose total length is shorter than that of the conventional filter, is capable of reducing changes in center frequency of a passband, bandwidth, and the like that would result from changes in ambient temperature. In other words, the characteristics of the filter 1 are highly stable to changes in ambient temperature.

Arrangement of Waveguide Apertures $AP_I$ and $AP_O$

As illustrated in (b) of FIG. 1, the waveguide aperture $AP_I$, which serves as an input port, is provided in a region that is on the opposite side (positioned downstream in the negative y axis direction) of the resonator 10 from the side (positioned downstream in the positive y axis direction) facing the resonator 50 and that intersects line AA'. The line AA' is a straight line that passes through the center $C_1$ of the resonator 10 and the center $C_5$ of the resonator 50.

Similarly, the waveguide aperture $AP_O$, which serves as an output port, is provided in a region that is on the opposite side (positioned downstream in the positive y axis direction) of the resonator 50 from the side (positioned downstream in the negative y axis direction) facing the resonator 10 and that intersects the line AA'.

Since the filter 1 includes the waveguide apertures $AP_I$ and $AP_O$, the waveguides 60 and 70 can be easily coupled to the input port and the output port, respectively. In addition, the input port and the output port are positioned such that they intersect a single straight line (line AA'). Therefore, the filter 1 makes it possible to cause line CC', which is the central axis of the waveguide 60, and line DD', which is the central axis of the waveguide 70, to coincide with each other. It follows that two such filters 1 can be arranged so as to run along each other. Thus, the filter 1 can be suitably used as, for example, a filter that resides between a pair of directional couplers of a diplexer.

Note that, by adjusting (optimizing) the offset $\Delta_{off}$ which is the distance between the line AA' and the line CC', it is possible to reduce return loss that would occur at the junction between the waveguide 60 and the resonator 10, that is, at the waveguide aperture $AP_I$. Similarly, by adjusting (optimizing) the offset $\Delta_{offO}$ which is the distance between the line AA' and the line DD', it is possible to reduce return loss that would occur at the junction between the waveguide 70 and the resonator 50, that is, at the waveguide aperture $AP_O$. The filter 1 preferably has a shape which is symmetric with respect to a straight line that passes through the center $C_3$ and that is parallel to the x axis. Therefore, it is preferable that the offset $\Delta_{offI}$ and the offset $\Delta_{offO}$ are equal to each other.

Furthermore, there may be cases where changes of the design width $W_6$ of the waveguide 60 and the design width $W_7$ of the waveguide 70 lead to an increase in return loss at the waveguide aperture $AP_I$ and the waveguide aperture $AP_O$. In the filter 1, the design parameters for the resonators 10 to 50 can be set independently of the widths $W_6$ and $W_7$, and, in addition, adjustments of the offsets $\Delta_{off}$ make it possible to reduce the return loss. As such, the filter 1 is a filter in which the widths of the respective waveguides 60 and 70 can be easily changed with little or no increase in return loss at the waveguide aperture $AP_I$ and the waveguide aperture $AP_O$.

Variations 1 to 4

Figure 2:
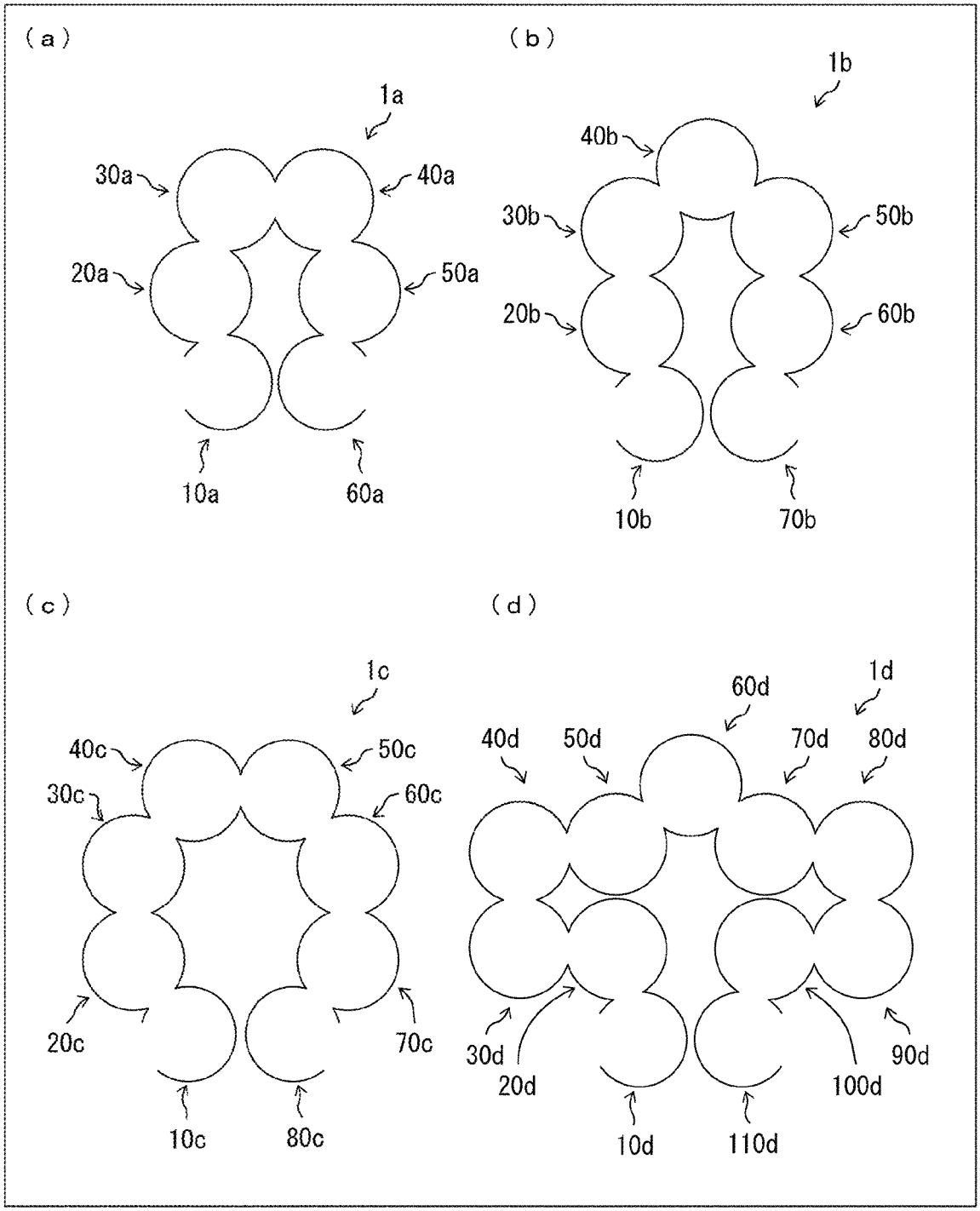

The following description will discuss filters 1*a* to 1*d* which are Variations 1 to 4 of the filter 1, with reference to (a) to (d) of FIG. 2. (a) to (d) of FIG. 2 are plan views of the respective filters 1*a* to 1*d*. In the filters 1*a* to 1*d* shown in (a) to (d) of FIG. 2, respectively, one of each pair of broad walls is not illustrated.

The filter 1*a* includes the following six resonators: resonators 10*a*, 20*a*, 30*a*, 40*a*, 50*a*, and 60*a*. The filter 1*b* includes the following seven resonators: resonators 10*b*, 20*b*, 30*b*, 40*b*, 50*b*, 60*b*, and 70*b*. The filter 1*c* includes the following eight resonators: resonators 10*c*, 20*c*, 30*c*, 40*c*, 50*c*, 60*c*, 70*c*, and 80*c*. The filter 1*d* includes the following eleven resonators: resonators 10*d*, 20*d*, 30*d*, 40*d*, 50*d*, 60*d*, 70*d*, 80*d*, 90*d*, 100*d*, and 110*d*.

As described above, in a filter in accordance with an aspect of the present invention, the number of resonators of the filter is not limited. The number of resonators of a filter, in other words, the number of poles of a filter, can be any number depending on the desired filter characteristics (such as the center frequency of a passband, bandwidth, and cutoff sharpness at about lower limit frequency and upper limit frequency of the passband), and the number may be an odd number or an even number.

Variations 5 and 6

Figure 3:
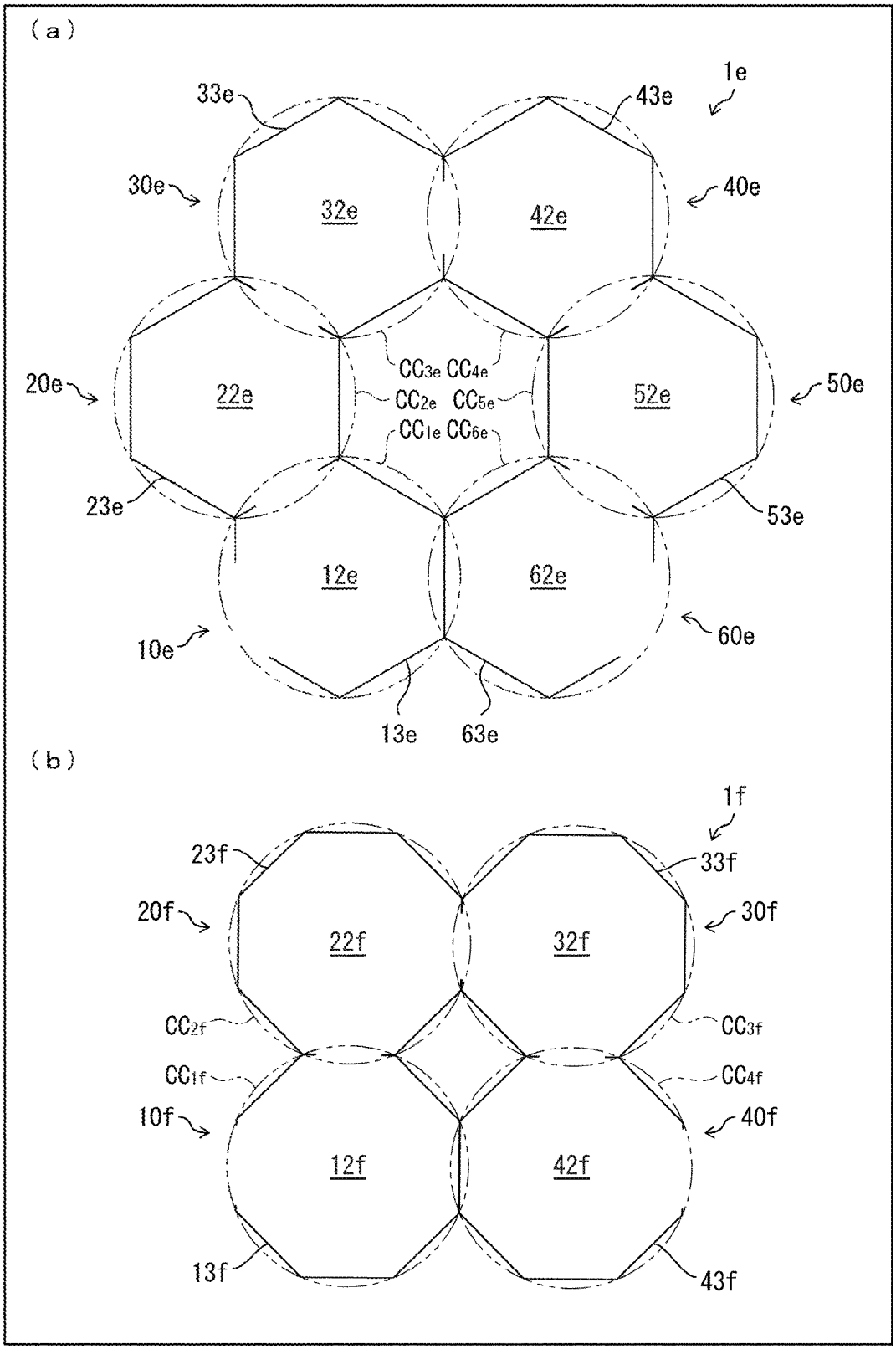

The following description will discuss filters 1*e* and 1*f* which are Variations 5 and 6 of the filter 1, with reference to (a) and (b) of FIG. 3. (a) and (b) of FIG. 3 are plan views of the respective filters 1*e* and 1*f*. In the filters 1*e* and 1*f* shown in (a) and (b) of FIG. 3, respectively, one of each pair of broad walls is not illustrated.

The filter 1*e* includes the following six resonators: resonators 10*e*, 20*e*, 30*e*, 40*e*, 50*e*, and 60*e*. The filter 1*e* includes broad walls each in the shape of a regular hexagon, in place of the circular broad walls 11, 12, 21, 22, 31, 32, 41, 42, 51, and 52 of the filter 1 illustrated in (b) of FIG. 1. The resonator 10*e* includes a pair of broad walls 12*e* each in the shape of a regular hexagon, one of which is not illustrated in (a) of FIG. 3. Similarly, the resonators 20*e* to 60*e* include pairs of broad walls 22*e* to 62*e* each in the shape of a regular hexagon, respectively.

Circumcircles $CC_{1e}$ to $CC_{6e}$ are circumcircles of the broad walls 12*e* to 62*e*, respectively. As such, a variation of the filter 1 may employ the broad walls 12*e* to 62*e* each in the shape of a regular polygon. Even in cases where the broad walls 12*e* to 62*e* are each in the shape of a regular polygon, the filter 1*e* brings about similar effects to those provided by the filter 1 illustrated in FIG. 1, provided that two resonators are arranged such that $D<R_1+R_2$ is satisfied, where $R_1$ and $R_2$ represent the radii of circumcircles of broad walls of two resonators coupled to each other and D represents the center-to-center distance between these two resonators.

The filter 1*f* includes the following four resonators: resonators 10*f*, 20*f*, 30*f*, and 40*f*. The resonator 10*f* includes a broad wall 12*f* in the shape of a regular octagon. Similarly, the resonators 20*f* to 40*f* include respective broad walls 22*f* to 42*f* each in the shape of a regular octagon.

Note that the shape employed in a filter in accordance with an aspect of the present invention is not limited to a regular hexagon and a regular octagon, and may be any regular polygon with six or more vertices.

Configuration Example

Figure 5:
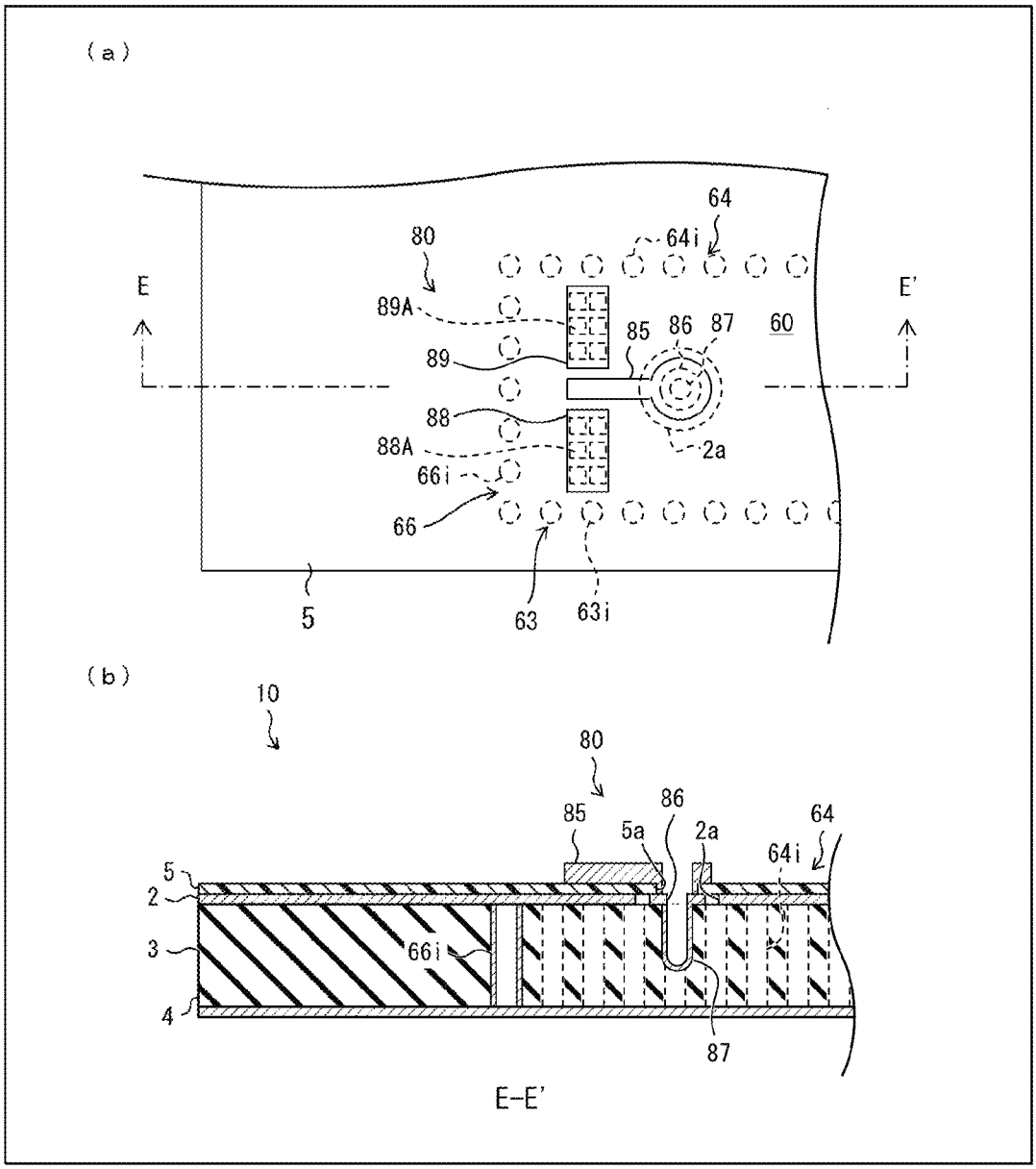

The following description will discuss another example of a configuration of the filter 1 illustrated in FIG. 1, with reference to FIGS. 4 and 5. FIG. 4 is a perspective view illustrating an example of a configuration in which the filter 1 is arranged using a post-wall waveguide technique. In FIG. 4, the conductor layers 2 and 4 are drawn in imaginary lines (dot-dot-dash lines). This is for easy description of a plurality of conductor posts in the substrate 3. (a) and (b) of FIG. 5 are a plan view and a cross-sectional view of a converter 80, respectively. The converter 80 is capable of being provided at an end of the waveguide 60 connected to the input port of the filter 1 illustrated in FIG. 4.

Post-Wall Waveguide

The filter 1 in accordance with this configuration example employs a post-wall waveguide technique, and is constituted by the substrate 3 made of a dielectric material having the conductor layer 2 and the conductor layer 4 on opposite surfaces thereof. The substrate 3 corresponds to the dielectric substrate recited in the claims. The conductor layer 2 and the conductor layer 4, which are a pair of conductor layers, function as a pair of broad walls that form the resonators 10 to 50 and the waveguides 60 to 70. The substrate 3 has therein a plurality of through-holes that pass through the substrate 3 from one surface of the substrate 3 to the other surface of the substrate 3. The through-holes each have a conductor film on the inner wall thereof such that the conductor layer 2 and the conductor layer 4 are in electrical communication with each other. That is, each of the through-holes has a conductor post therein which allows the conductor layer 2 and the conductor layer 4 to be in electrical communication with each other.

A post wall (the conductor post group recited in the claims) constituted by a plurality of conductor posts arranged at certain intervals in a palisade arrangement functions as a kind of conducting wall that reflects electromagnetic waves within a band that depends on the intervals. The filter 1 in accordance with this configuration example employs such post walls as narrow walls that form the resonators 10 to 50 and the waveguides 60 to 70.

For example, the narrow wall 13 of the resonator 10 is constituted by a plurality of conductor posts 13*i* (i is a positive integer) arranged in a circle in a palisade arrangement. Similarly, the narrow walls 23 to 53 of the resonators 20 to 50 are constituted by pluralities of conductor posts 23*i* to 53*i*, respectively, and the narrow walls 63, 64, 73, and 74 of the waveguides 60 to 70 are constituted by pluralities of conductor posts 63*i*, 64*i*, 73*i*, and 74*i*, respectively.

The waveguide aperture $AP_{12}$, through which the resonator 10 and the resonator 20 are electromagnetically coupled, is formed by missing one(s) of the conductor posts 13*i* and missing one(s) of the conductor posts 23*i*. The waveguide apertures $AP_{23}$, $AP_{34}$, $AP_{45}$, $AP_I$, and $AP_O$ are formed in a similar manner.

The filter 1 that employs a post-wall waveguide technique can be easily produced and can be reduced in weight, as compared to a filter 1 that employs a metal waveguide tube technique.

Converter

In the filter 1 illustrated in FIG. 4, the waveguide 60 may have the converter 80 (the input converter recited in the claims) illustrated in FIG. 5 provided at its opposite end from the resonator 10 (at the end positioned downstream in the negative y axis direction). Similarly, the waveguide 70 may have the converter 80 (the output converter recited in the claims) provided at its opposite end from the resonator 50 (at the end positioned downstream in the positive y axis direction). The following description is based on the converter 80 provided at the end of the waveguide 60 as an example.

In the case where the converter 80 is provided at the end of the waveguide 60, a short wall 66 is formed at that end. The short wall 66 is a post wall constituted by a plurality of conductor posts 66*i* arranged in a palisade arrangement. The short wall 66 is a counterpart of the short wall 65, and closes the opposite end of the waveguide 60 from the resonator 10.

As illustrated in (a) and (b) of FIG. 5, the converter 80 includes a signal line 85, a pad 86, a blind via 87, and electrodes 88 and 89.

A dielectric layer 5 is a layer made of a dielectric material provided on a surface of the conductor layer 2. The dielectric layer 5 has an opening 5*a* that overlaps a waveguide of the converter 80. The conductor layer 2 of the converter 80 has an opening 2*a* that overlaps the opening 5*a*. The opening 2*a* is formed such that the opening 2*a* includes the opening 5*a* within its range. The opening 2*a* functions as an anti-pad.

The signal line 85 is a long narrow conductor disposed on a surface of the dielectric layer 5. One end portion of the signal line lies in a region that surrounds the opening 5*a* and that overlaps the opening 2*a*. The signal line 85 and the conductor layer 2 form a microstrip line.

The pad 86 is a circular conductor layer provided on the surface of the substrate 3 on which the conductor layer 2 is provided. The pad 86 is located within the opening 2*a* in the conductor layer 2 such that the pad 86 is insulated from the conductor layer 2.

The substrate 3 has, on the surface thereof, a non-through-hole extending inward from the surface on which the conductor layer 2 is provided. The blind via 87 is constituted by a tube-shaped conductor film disposed on the inner wall of the non-through-hole. The blind via 87 is connected to the one end portion of the signal line 85 via the pad 86 so that the blind via 87 and the signal line 85 are in electrical communication with each other. Specifically, the blind via 87 is connected to the one end portion of the signal line 85 and is formed in the substrate 3 through the openings 2*a* and 5*a*. The blind via 87 corresponds to the conductor pin recited in the claims.

The electrodes 88 and 89 are disposed on the surface of the dielectric layer 5. The electrodes 88 and 89 are each located near the other end portion of the signal line 85 such that the other end portion of the signal line 85 lies between the electrodes 88 and 89.

The dielectric layer 5 has a plurality of through-holes in a region that overlaps the electrode 58. The plurality of through-holes are filled with conductors serving as vias 88A. The vias 88A achieve a short circuit between the electrode 88 and the conductor layer 2. Vias 89A, which are configured similarly to the vias 88A, achieve a short circuit between the electrode 89 and the conductor layer 2. The thus-configured electrode 88 and electrode 89 each function as a ground, and therefore the electrode 88, the electrode 89, and the single line 85 achieve a ground-signal-ground interface.

The thus-configured converter 80 carries out a conversion between a mode that propagates through the microstrip line and a mode that propagates through the waveguide 60. Therefore, the converter 80 is capable of easily coupling the microstrip line to each of the input and output ports. Furthermore, an RFIC can be easily connected to the interface constituted by the signal line 85 and the electrodes 88 and 89, with use of a bump or the like.

This configuration example was described based on the assumption that the converter 80 is provided at the end of the waveguide 60 or the end of the waveguide 70. That is, the configuration example was described based on the assumption that the converter 80 is coupled to the resonator 10 or the resonator 50 via the waveguide 60 or the waveguide 70. However, the converter 80 may be provided so as to be directly coupled to the resonator 10 or the resonator 50. Specifically, the blind via 87 of the converter 80 may be formed in the resonator 10 or the resonator 50 so as to extend inward from an opening in a part of the broad wall 11 of the resonator 10 or a part of the broad wall 51 of the resonator 50.

Embodiment 2

Figure 6:
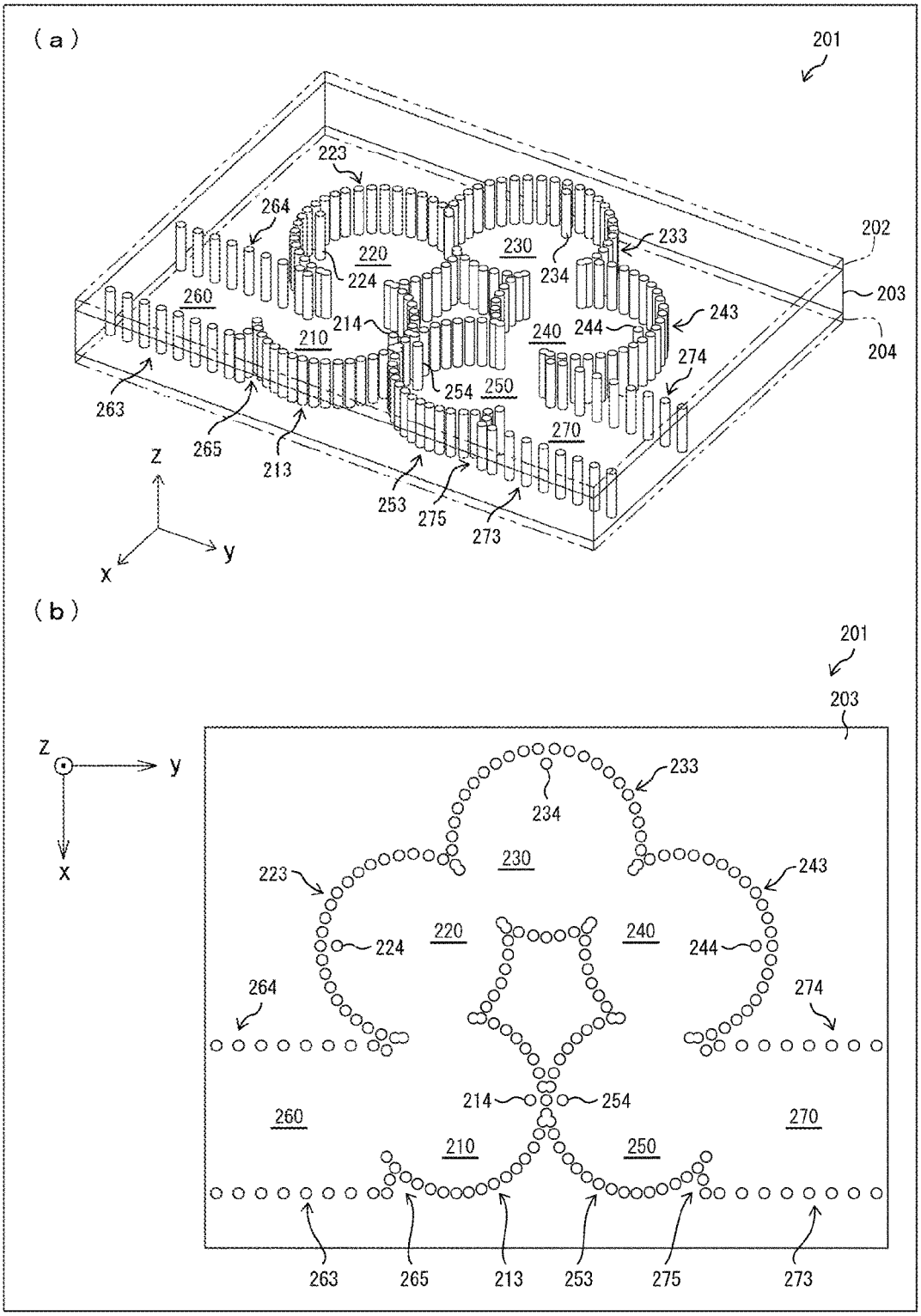

The following description will discuss a filter in accordance with Embodiment 2 of the present invention, with reference to FIG. 6. (a) of FIG. 6 is a perspective view illustrating a filter 201 in accordance with Embodiment 2. (b) of FIG. 6 is a plan view of the filter 201. Note that, in the filter 201 illustrated in (b) of FIG. 6, a conductor layer 202 constituting one of a pair of broad walls (the broad wall positioned downstream in the positive z axis direction) is not illustrated. This is for easy description of arrangements of conductor posts constituting narrow walls 213, 223, 233, 243, 253, 263, 264, 273, and 274 that form resonators 210 to 250 and waveguides 260 and 270.

The filter 201 is different from the filter 1 illustrated in FIG. 4 in that the filter 201 further includes conductor posts 214, 224, 234, 244, and 254. Therefore, in Embodiment 2, the conductor posts 214, 224, 234, 244, and 254 are described, and descriptions for the rest of the configuration are omitted. Note that the reference numbers assigned to the members of the filter 201 are obtained by changing those of the members of the filter 1 such that each of the reference numbers is in the 200s.

The conductor posts 214, 224, 234, 244, and 254 are described based on the conductor post 214 as an example. The conductor post 214 is a projection made of a conductor that projects inward from one of the broad walls of the resonator 210 (from a part of the conductor layer 2) to reach the other of the broad walls of the resonator 210 (reach a part of the conductor layer 4). The conductor post 214 is similar in configuration to the conductor posts constituting the narrow wall 213. The conductor posts 224, 234, 244, and 254 are configured in a similar manner to the conductor post 214.

Since the resonator 210 includes the conductor post 214, resonance frequency can be changed, that is, can be caused to differ from that of the resonator 210 which includes no conductor post 214. It follows that the resonance frequency of the filter 201 can be changed.

The degree of change in resonance frequency that results from the addition of the conductor post 214 can be changed by adjusting the position of the conductor post 214. This means that the position of the conductor post 214 can be used as a design parameter for adjusting characteristics of the filter 201. Thus, the characteristics of the filter 201 can be easily adjusted without having to change the design shapes of the respective resonators 210 to 250.

Note that, in the filter 201, the resonators 210 to 250 have the respective conductor posts 214 to 254, which are projections. However, such a projection need only be provided in at least one resonator.

Variation 7

Figure 7:
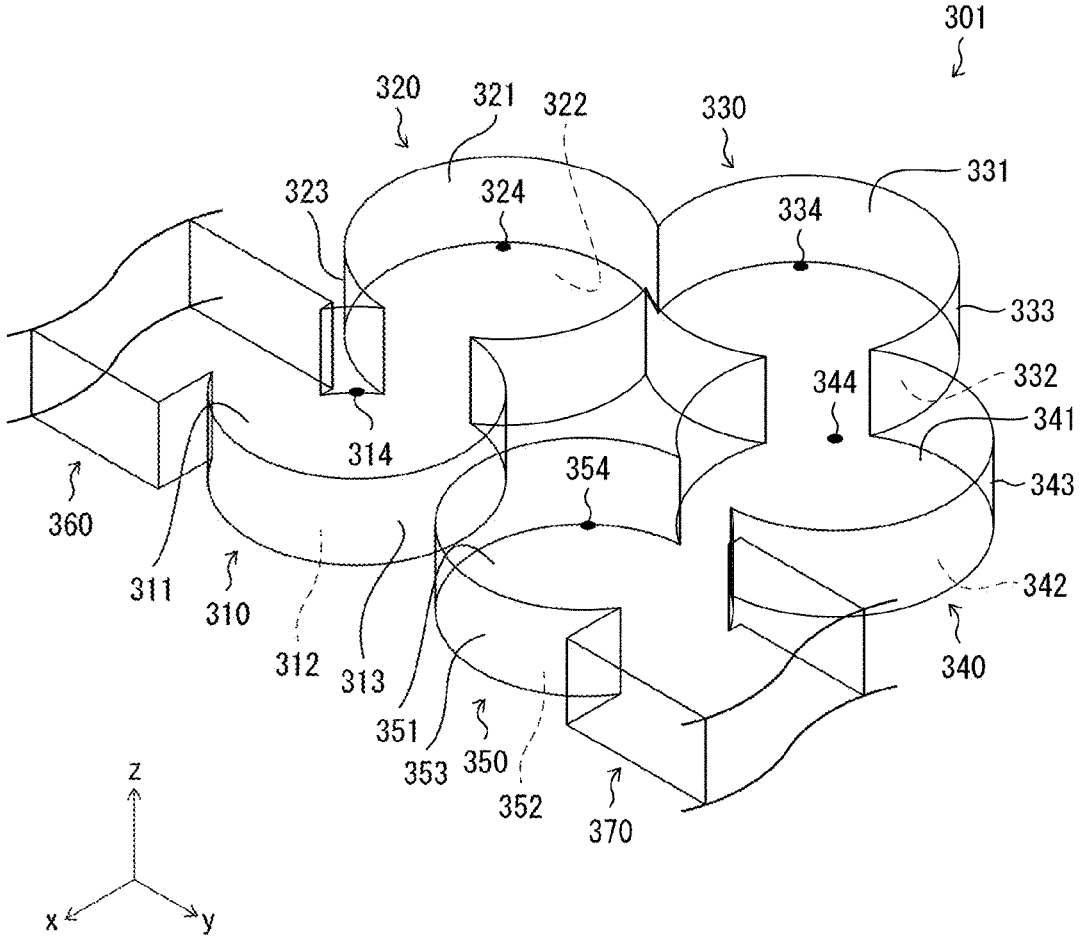
FIG. 7 is a perspective view of a filter which is Variation 7 of the present invention.

The following description will discuss a filter 301 which is Variation 7 of the present invention, with reference to FIG. 7. FIG. 7 is a perspective view of the filter 301. The filter 301 is different from the configuration of the filter 201 in that the filter 301 employs projections 314, 324, 334, 344, and 354 in place of the conductor posts 214, 224, 234, 244, and 254. Therefore, in Variation 7, the projections 314 to 354 are described, and descriptions for the rest of the configuration are omitted. Note that the reference numbers assigned to the members of the filter 301 are obtained by changing those of the members of the filter 201 such that each of the reference numbers is in the 300s.

The projection 314 is a projection made of a conductor that projects inward from a broad wall 311, which is one of the broad walls of a resonator 310. When the projection 314 and the conductor post 214 are compared, the projection 314 (1) is closer to the center of the broad wall 311 (center of the resonator 310) than the conductor post 214 and (2) projects from the broad wall 311 to a lesser extent than the conductor post 214. The projections 324, 334, 344, and 354 are configured in a similar manner to the projection 314.

The degree of change in resonance frequency that results from the formation of the projection 314 (or the conductor post 214) (1) becomes smaller as the distance from the projection 314 (or the conductor post 214) to a narrow wall 313 (or 213) becomes smaller, and becomes larger as the distance from the projection 314 (or the conductor post 214) to the center of the broad wall 311 (or 211) becomes smaller and (2) becomes smaller as the amount of projection of the projection 314 (or the conductor post 214) decreases, and becomes larger as the amount of projection of the projection 314 (or the conductor post 214) increases.

In cases where a projection is positioned at or near the center of the broad wall 311 like the projection 314, the amount of projection is preferably small so that a change in resonance frequency does not become too large.

As such, by adjusting the position of a projection and the amount of projection, it is possible to easily adjust the characteristics of the filter 301 without having to change the design shapes of the respective resonators 310 to 350.

Example and Comparative Example

The following description will discuss a filter 1, which is an Example of the present invention, and a filter 501, which is a Comparative Example, with reference to FIGS. 8 to 10. FIG. 8 is a plan view illustrating the filter 1 and the filter 501. (a) of FIG. 9 is a chart showing reflection characteristics (frequency dependence of S-parameter S(1, 1)) of the filter 1 and the filter 501. (b) of FIG. 9 is a chart showing transmission characteristics (frequency dependence of S-parameter S(2, 1)) of the filter 1 and the filter 501. (a) of FIG. 10 is a contour diagram showing an electric field distribution in the filter 1. (b) of FIG. 10 is a contour diagram showing an electric field distribution in the filter 501.

The above filter 1 is the same as the filter 1 illustrated in FIG. 1 in which the radii of broad walls of resonators and the center-to-center distances between the broad walls, which are design parameters, are set as below. Note that the values of $D_{12}$, $D_{45}$, $D_{23}$, and $D_{34}$ have been rounded off to the nearest integers.

$R_1$, $R_5$=749 μm
$R_2$, $R_4$=787 μm
$R_3$=792 μm
$D_{12}$, $D_{45}$=1446 μm
$D_{23}$, $D_{34}$=1449 μm

The filter 501 is a resonator-coupled filter in which rectangle resonators 510, 520, 530, 540, and 550 are coupled in a straight line, and the length and width of the resonators 510 to 550 are set as shown in FIG. 8.

The above design parameters for the filter 1 were set so that the characteristics of the filter 1 would be as close as possible to those of the filter 501.

(a) and (b) FIG. 9 show that the characteristics of the filter 1 match to a great extent with the characteristics of the filter 501. The S-parameters S(1, 1) in the passband indicate that the filter 1 reduces the reflection to a greater extent, and the S-parameters S(2, 1) in the passband indicate that the filter 1 shows a higher transmittance.

(a) of FIG. 10 shows that, in the filter 1, an electromagnetic wave coupled from the waveguide 60 to the resonator 10 propagates through the resonators 20 to 40 to the resonator 50, and is coupled from the resonator 50 to the waveguide 70. (a) of FIG. 10 also shows that an electric field is distributed throughout the resonators 10 to 50. On the contrary, (b) of FIG. 10 shows that the resonators 510 to 550 have, at their corners, some areas in which no electric field is distributed (or the strength of the electric field is very low). It is inferred that such a difference between the filter 1 and the filter 501 is attributed to a difference in shape of the broad walls of the resonators. These results demonstrate that, in the filter 1, cavities of the respective resonators can be used more effectively than those of the filter 501, because the shapes of the broad walls are circular except in the portions where the waveguide apertures $AP_I$, $AP_{12}$, $AP_{23}$, $AP_{34}$, $AP_{45}$, and $AP_O$ are located.

As is clear from the above results, the use of the resonators 10 to 50, whose broad walls are circular in shape, made it possible to design a compact filter 1 having characteristics equal to or better than those of the filter 501 which includes the resonators 510 to 550 whose broad walls are rectangular in shape.

Variations 8 to 16

The following description will discuss filters 1*g* to 1*o* which are Variations 8 to 16 of the filter 1, with reference to FIGS. 11 to 14. (a) and (b) of FIG. 11 are plan views of the filter 1*g* and the filter 1*h*. (a) to (c) of FIG. 12 are plan views of the filters 1*i* to 1*k*. (a) to (d) of FIG. 13 are plan views of the filter 1*l* to the filter 1*o*. FIG. 14 is a chart showing reflection characteristics (frequency dependence of S-parameter S(1,1)) of the filter 1 and the filters 1*g* to 1*o*.

Each of the filters 1*g* to 1*o* is different in shape from the filter 1 illustrated in FIG. 1. More specifically, each of the filters 1*g* to 1*o* is different from the filter 1 in that one or more of its resonators are different in position from corresponding one(s) of the five resonators 10 to 50 of the filter 1. Note that the shape of each of the filters 1*g* to 1*o* is obtained by at least one of (i) a rotation of one or more resonators of the filter 1 about a certain point and (ii) a reflection of one or more resonators of the filter 1 about a certain straight line.

In the following description, the positions of the resonators moved to obtain the respective filters 1*g* to 1*o* are discussed, and also the reflection characteristics (frequency dependence of S-parameter S(1,1)) obtained by each of the filters 1*g* to 1*o* are discussed.

Each of the filters 1*g* to 1*o* includes resonators corresponding to the resonators 10 to 50 which are included in the filter 1 and waveguides corresponding to the waveguides 60 and 70 which are included in the filter 1. Specifically, the filter 1*g* includes resonators 10*g* to 50*g* and waveguides 60*g* and 70*g* (see (a) of FIG. 11), the filter 1*h* includes resonators 10*h* to 50*h* and waveguides 60*h* and 70*h* (see (b) of FIG. 11), the filter 1*i* includes resonators 10*i* to 50*i* and waveguides 60*i* and 70*i* (see (a) of FIG. 12), the filter 1*j* includes resonators 10*j* to 50*j* and waveguides 60*j* and 70*j* (see (b) of FIG. 12), the filter 1*k* includes resonators 10*k* to 50*k* and waveguides 60*k* and 70*k* (see (c) of FIG. 12), the filter 1*l* includes resonators 101 to 501 and waveguides 601 and 701 (see (a) of FIG. 13), the filter 1*m* includes resonators 10*m* to 50*m* and waveguides 60*m* and 70*m* (see (b) of FIG. 13), the filter 1*n* includes resonators 10*n* to 50*n* and waveguides 60*n* and 70*n* (see (c) of FIG. 13), and the filter 1*o* includes resonators 10*o* to 50*o* and waveguides 60*o* and 70*o* (see (d) of FIG. 13).

In the following description, the centers of the resonators 10*g* to 50*g* of the filter 1*g* are referred to as centers $C_{1g}$ to $C_{5g}$, as is the case of each of the resonators 10 to 50 of the filter 1. Similarly, the centers of the resonators 10*h* to 50*h* of the filter 1*h* are referred to as centers $C_{1h}$ to $C_{5h}$, respectively, the centers of the resonators 10*i* to 50*i* of the filter 1*i* are referred to as centers $C_{1i}$ to $C_{5i}$, respectively, the centers of the resonators 10*j* to 50*j* of the filter 1*j* are referred to as centers $C_{1j}$ to $C_{5j}$, respectively, the centers of the resonators 10*k* to 50*k* of the filter 1*k* are referred to as centers $C_{1k}$ to $C_{5k}$, respectively, the centers of the resonators 101 to 501 of the filter 1*l* are referred to as centers $C_{1l}$ to $C_{5l}$, respectively, the centers of the resonators 10*m* to 50*m* of the filter 1*m* are referred to as centers $C_{1m}$ to $C_{5m}$, respectively, the centers of the resonator 10*n* to 50*n* of the filter 1*n* are referred to as centers $C_{1n}$ to $C_{5n}$, respectively, and the centers of the resonators 10*o* to 50*o* of the filter 1*o* are referred to as centers $C_{1o}$ to $C_{5o}$, respectively.

As illustrated in (a) of FIG. 11, the filter 1*g* is such that its resonators 40*g* and 50*g* are obtained by a 30 degree counterclockwise rotation of corresponding resonators of the filter 1 about the center $C_{3g}$. As illustrated in (b) of FIG. 11, the filter 1*h* is such that its resonator 50*h* is obtained by a 90 degree counterclockwise rotation of a corresponding resonator of the filter 1 about the center $C_{4h}$.

As illustrated in (a) of FIG. 12, the filter 1*i* is such that its resonators 40*g* and 50*g* are obtained by a 180 degree counterclockwise rotation of corresponding resonators of the filter 1 about the center $C_{3i}$. Alternatively, the filter 1*i* is such that its resonators 40*g* and 50*g* are obtained by (i) a first reflection of corresponding resonators of the filter 1 about a straight line that passes through the center $C_{3i}$ and that is parallel to the y axis and (ii) a second reflection of the resulting intermediate resonators about a straight line that passes through the center $C_{3i}$ and that is parallel to the x axis. As illustrated in (b) of FIG. 12, the filter 1*j* is such that its resonators 30*j* to 50*j* are obtained by a 45 degree clockwise rotation of corresponding resonators of the filter 1*i* about the center $C_{2j}$. As illustrated in (c) of FIG. 12, the filter 1*k* is such that its resonator 50*k* is obtained by a 45 degree clockwise rotation of a corresponding resonator of the filter 1*j* about the center $C_{4k}$. Note that, in (a) of FIG. 12, the intermediate resonators corresponding to the resonator 40*g* and 50*g*, which are obtained as a result of the first reflection about the straight line that passes through the center $C_3$ and that is parallel to the y axis, are not illustrated.

As illustrated in (a) of FIG. 13, the filter 1*l* is such that its resonators 401 and 501 are obtained by a reflection of corresponding resonators of the filter 1 about a straight line that passes through the center $C_{31}$ and that is parallel to the y axis. As illustrated in (b) of FIG. 13, the filter 1*m* is such that its resonators 40*m* and 50*m* are obtained by a 90 degrees clockwise rotation of corresponding resonators of the filter 1*l* about the center $C_{3m}$. As illustrated in (c) of FIG. 13, the filter 1*n* is such that its resonator 50*m* is obtained by a 30 degrees counterclockwise rotation of a corresponding resonator of the filter 1*m* about the center $C_{4n}$. As illustrated in (d) of FIG. 13, the filter 1*o* is such that its resonator 50*o* is obtained by a 20 degree counterclockwise rotation of a corresponding resonator of the filter 1*n* about the center $C_{4o}$.

It was found that each of the filters 1*g* to 1*o*, which are variations resulting from reflection and/or rotation, shows a center frequency and a bandwidth at −10 dB which are the same level as those of the filter 1, as shown in FIG. 14. It was also found that, when a focus is placed on the bandwidth at −15 dB, the filter 1*j*, the filter 1*n*, and the filter 1*o* each show a narrower band width.

Each of the filters 1*g* to 1*o* includes five electromagnetically coupled resonators each of which has a circular broad wall, similarly to the filter 1. Furthermore, two resonators, which are coupled together, of the five resonators are arranged such that $D<R_1+R_2$ is satisfied, where $R_1$ and $R_2$ represent the radii of circumcircles of broad walls of the two resonators and D represents the center-to-center distance between the two resonators. Therefore, each of the filters 1*g* to 1*o* makes it possible to reduce the number of design parameters and, in turn, makes it easy to design a filter with desired characteristics, similarly to the filter 1.

It was also found that a filter in accordance with an aspect of the present invention maintains substantially the same center frequency and does not experience great changes in bandwidth, even in cases where the position of each resonator is changed by rotation and/or reflection as described earlier. This indicates that a filter in accordance with an aspect of the present invention offers a high degree of flexibility in determining the positions of the waveguide 60 and the waveguide 70 and the direction of extension of the waveguide 60 and the waveguide 70 (that is, a high degree of design flexibility).

The present invention is not limited to the embodiments, but can be altered by a skilled person in the art within the scope of the claims. The present invention also encompasses, in its technical scope, any embodiment derived by combining technical means disclosed in differing embodiments.

Aspects of the present invention can also be expressed as follows:

In order to attain the foregoing object, a filter (1, 201, 301) in accordance with a first aspect of the present invention is a filter (1, 201, 301) including a plurality of resonators (10 to 50, 210 to 250, 310 to 350) which are electromagnetically coupled, the plurality of resonators (10 to 50, 210 to 250, 310 to 350) each having a broad wall (11, 12, 21, 22, 31, 32, 41, 42, 51, 52, 311, 312, 321, 322, 331, 332, 341, 342, 351, 352) that is in a shape of a circle or a regular polygon with six or more vertices, two resonators, which are coupled together, of the plurality of resonators (10 to 50, 210 to 250, 310 to 350) being arranged such that $D<R_1+R_2$ is satisfied, where $R_1$ and $R_2$ represent radii of circumcircles of the broad walls of the two resonators and D represents a center-to-center distance between the two resonators.

According to the above arrangement, when a focus is placed on two resonators, which are coupled together, of the plurality of resonators (10 to 50,210 to 250,310 to 350), the shape of a combination of the circumcircles of the respective two resonators is symmetric with respect to a straight line that connects the centers of the two circumcircles. Therefore, the degree of symmetry of the shape of this filter is higher than that of the filter disclosed in Patent Literature 1. This makes it possible to reduce the number of design parameters.

Furthermore, according to the above arrangement, the shape of each of the broad walls (11, 12, 21, 22, 31, 32, 41, 42, 51, 52, 311, 312, 321, 322, 331, 332, 341, 342, 351, 352) that form the respective plurality of resonators (10 to 50, 210 to 250, 310 to 350) is in the shape of a circle or a regular polygon with six or more vertices. As such, this filter (1, 201, 301) has a high degree of symmetry concerning the shape thereof as compared to the filter disclosed in Non-patent Literature 1. This makes it possible to reduce the number of design parameters.

Accordingly, this filter (1, 201, 301) makes it possible to easily design a filter (1, 201, 301) with desired characteristics, as compared to conventional filters.

A filter in accordance with a second aspect of the present invention is preferably arranged such that the plurality of resonators include a first-pole resonator that has an input port (waveguide aperture $AP_I$) and a last-pole resonator that has an output port (waveguide aperture $AP_O$), and the plurality of resonators are arranged such that the first-pole resonator and the last-pole resonator are adjacent to each other.

According to the above arrangement, the total length of the filter can be reduced as compared to cases where the plurality of resonators are arranged in a straight line.

A filter in accordance with a third aspect of the present invention is preferably arranged such that: the plurality of resonators include a first-pole resonator that has an input port (waveguide aperture $AP_I$) and a last-pole resonator that has an output port (waveguide aperture $AP_O$); the first-pole resonator has a waveguide aperture that functions as the input port (waveguide aperture $AP_I$), the waveguide aperture being positioned on an opposite side of the first-pole resonator from the last-pole resonator such that the waveguide aperture intersects a straight line that passes through a center of the first-pole resonator and a center of the last-pole resonator; and the last-pole resonator has a waveguide aperture that functions as the output port (waveguide aperture $AP_O$), the waveguide aperture being positioned on an opposite side of the last-pole resonator from the first-pole resonator such that the waveguide aperture intersects the straight line.

According to the above arrangement, a waveguide (60, 70, 260, 270, 360, 370) or a waveguide tube can be easily coupled to the input port (waveguide aperture $AP_I$) and the output port (waveguide aperture $AP_O$). Furthermore, since the input port (waveguide aperture $AP_I$) and the output port (waveguide aperture $AP_O$) are positioned so as to intersect a single straight line, the filter (1, 201, 301) can be suitably used as a filter that resides between, for example, a pair of directional couplers of a diplexer.

A filter in accordance with a fourth aspect of the present invention may be arranged such that: the plurality of resonators include a first-pole resonator that has an input port (waveguide aperture $AP_I$) and a last-pole resonator that has an output port (waveguide aperture $AP_O$); the first-pole resonator and the last-pole resonator are coupled directly or via respective waveguides (60, 70, 260, 270, 360, 370) to an input converter (converter 80) and an output converter (converter 80), respectively; and each of the input and output converters (converters 80) is comprised of a long narrow conductor that is part of a microstrip line comprised of (i) the long narrow conductor and (ii) one of a pair of the broad walls of the first-pole or last-pole resonator or one of a pair of broad walls of a corresponding one of the waveguides (60, 70, 260, 270, 360, 370) and a conductor pin (blind via 87) that is in electrical communication with an end of the long narrow conductor and that extends toward an interior of the first-pole or last-pole resonator or toward an interior of the corresponding one of the waveguides (60, 70, 260, 270, 360, 370) through an opening in the one of the pair of broad walls of the first-pole or last-pole resonator or in the one of the pair of broad walls of the corresponding one of the waveguides (60, 70, 260, 270, 360, 370).

Each of the input and output converters (converters 80) carries out a conversion between a mode that propagates through the microstrip line and a mode that propagates through the first-pole resonator and the last-pole resonator. As such, according to the above arrangement, it is possible to easily couple the microstrip line to each of the input and output ports (waveguide aperture $AP_I$ and waveguide aperture $AP_O$).

A filter (1, 1*b*, 1*d*, 201, 301) in accordance with a fifth aspect of the present invention may be arranged such that the number of the plurality of resonators (10 to 50, 10*b* to 70*b*, 10*d* to 110*d*, 210 to 250, 310 to 350) is an odd number.

Each of the plurality of resonators is in the shape of a circle or a regular polygon with six or more vertices when seen in top view. Therefore, even in cases where the number of the plurality of resonators is an odd number, this filter can be arranged such that the plurality of resonators are symmetric with respect to a line. This makes it possible to reduce the number of design parameters for use in designing a filter, and thus makes it easy to design a filter.

A filter (1, 201) in accordance with a sixth aspect of the present invention is preferably arranged such that: each of the plurality of resonators (10 to 50, 210 to 250) is formed by a pair of the broad walls (11, 12, 21, 22, 31, 32, 41, 42, 51, 52, part of wall 2, part of wall 4) and a narrow wall (13, 23, 33, 43, 53, 213, 223, 233, 243, 253) that resides between the pair of broad walls (11, 12, 21, 22, 31, 32, 41, 42, 51, 52, part of wall 2, part of wall 4); the pair of broad walls (11, 12, 21, 22, 31, 32, 41, 42, 51, 52) are constituted by a pair of conductor layers (2, 4, 202, 204) provided on opposite surfaces of a dielectric substrate (3); and the narrow wall (13, 23, 33, 43, 53, 213, 223, 233, 243, 253) passes through the dielectric substrate (3) and is constituted by a conductor post group (post walls) via which the pair of broad walls (11, 12, 21, 22, 31, 32, 41, 42, 51, 52, part of wall 2, part of wall 4) are in electrical communication with each other.

The above arrangement can be produced using a post-wall waveguide technique. The production of the filter using a post-wall waveguide technique is easier than the production of a filter using a metal waveguide tube technique, and also makes it possible to reduce weight.

A filter (301) in accordance with a seventh aspect of the present invention is preferably arranged such that at least one resonator of the plurality of resonators (310 to 350) further includes a projection (314, 324, 334, 344, 354) made of a conductor, the projection (314, 324, 334, 344, 354) projecting inward from one of a pair of the broad walls that form the at least one resonator.

According to the above arrangement, it is possible to change the resonance frequency of a resonator by adjusting the position of a projection (314, 324, 334, 344, 354) and the amount of inward projection of the projection (314, 324, 334, 344, 354) from one of the broad walls. Accordingly, it is possible to change the resonance frequency of this filter. This means that the position of a projection and the amount of projection of the projection (314, 324, 334, 344, 354) can be used as design parameters for adjusting the characteristics of this filter. As such, the characteristics of this filter (301) can be easily changed without having to change the design shapes of the respective plurality of resonators.

Note that the tip of the projection (314, 324, 334, 344, 354) may reach the other one of the broad walls or may be located inside the resonator and be short of the other one of the broad walls.

REFERENCE SIGNS LIST 1, 201, 301, 1*a* to 1*o*: filter
10, 20, 30, 40, 50, 210 to 250, 310 to 350, 10*a* to 50*a*, 10*b* to 50*b*, 10*c* to 50*c*, 10*d* to 50*d*, 10*e* to 50*e*, 10*f* to 50*f*, 10*g* to 50*g*, 10*h* to 50*h*, 10*i* to 50*i*, 10*j* to 50*j*, 10*k* to 50*k*, 10*l* to 50*l*, 10*m* to 50*m*, 10*n* to 50*n*, 10*o* to 50*o*: resonator
11, 12, 21, 22, 31, 32, 41, 42, 51, 52: broad wall
13, 23, 33, 43, 53: narrow wall
13*i*, 23*i*, 33*i*, 43*i*, 53*i*: conductor post
60, 70, 260, 270, 360, 370: waveguide
61, 62, 71, 72: broad wall
63, 64, 73, 74: narrow wall
63*i*, 64*i*, 73*i*, 74*i*: conductor post
65, 66, 75: short wall
80: converter (input converter and output converter)

The invention claimed is:

1. A filter comprising a plurality of resonators which are electromagnetically coupled,
the plurality of resonators each having a broad wall that is in a shape of a circle or a regular polygon with six or more vertices,
two resonators, which are coupled together, of the plurality of resonators being arranged such that $D<R_1+R_2$ is satisfied, where $R_1$ and $R_2$ represent radii of circumcircles of the broad walls of the two resonators and D represents a center-to-center distance between the two resonators, wherein
at least one resonator of the plurality of resonators further includes a projection made of a conductor, the projection projecting inward from one of a pair of the broad walls that form the at least one resonator.

2. The filter according to claim 1, wherein the plurality of resonators include a first-pole resonator that has an input port and a last-pole resonator that has an output port, and the plurality of resonators are arranged such that the first-pole resonator and the last-pole resonator are adjacent to each other.

3. The filter according to claim 1, wherein:
the plurality of resonators include a first-pole resonator that has an input port and a last-pole resonator that has an output port;
the first-pole resonator has a waveguide aperture that functions as the input port, the waveguide aperture being positioned on an opposite side of the first-pole resonator from the last-pole resonator such that the waveguide aperture intersects a straight line that passes through a center of the first-pole resonator and a center of the last-pole resonator; and
the last-pole resonator has a waveguide aperture that functions as the output port, the waveguide aperture being positioned on an opposite side of the last-pole resonator from the first-pole resonator such that the waveguide aperture intersects the straight line.

4. The filter according to claim 1, wherein
the number of the plurality of resonators is an odd number.

5. The filter according to claim 1, wherein:
each of the plurality of resonators is formed by a pair of the broad walls and a narrow wall that resides between the pair of broad walls;
the pair of broad walls are constituted by a pair of conductor layers provided on opposite surfaces of a dielectric substrate; and
the narrow wall passes through the dielectric substrate and is constituted by a conductor post group via which the pair of broad walls are in electrical communication with each other.

6. A filter comprising a plurality of resonators which are electromagnetically coupled,
the plurality of resonators each having a broad wall that is in a shape of a circle or a regular polygon with six or more vertices,
two resonators, which are coupled together, of the plurality of resonators being arranged such that $D<R_1+R_2$ is satisfied, where $R_1$ and $R_2$ represent radii of circumcircles of the broad walls of the two resonators and D represents a center-to-center distance between the two resonators, wherein:
the plurality of resonators include a first-pole resonator that has an input port and a last-pole resonator t output port;
the first-pole resonator and the last-pole resonator are coupled directly or via respective waveguides to an input converter and an output converter, respectively; and
each of the input and output converters is comprised of
a long narrow conductor that is part of a microstrip line comprised of (i) the long narrow conductor and (ii) one of a pair of the broad walls of the first-pole or last-pole resonator or one of a pair of broad walls of a corresponding one of the waveguides and
a conductor pin that is in electrical communication with an end of the long narrow conductor and that extends toward an interior of the first-pole or last-pole resonator or toward an interior of the corresponding one of the waveguides through an opening in the one of the pair of broad walls of the first-pole or last-pole resonator or in the one of the pair of broad walls of the corresponding one of the waveguides.

7. The filter according to claim 6, wherein the plurality of resonators are arranged such that the first-pole resonator and the last-pole resonator are adjacent to each other.

8. The filter according to claim 6, wherein:

the first-pole resonator has a waveguide aperture that functions as the input port, the waveguide aperture being positioned on an opposite side of the first-pole resonator from the last-pole resonator such that the waveguide aperture intersects a straight line that passes through a center of the first-pole resonator and a center of the last-pole resonator; and the last-pole resonator has a waveguide aperture that functions as the output port, the waveguide aperture being positioned on an opposite side of the last-pole resonator from the first-pole resonator such that the waveguide aperture intersects the straight line.

9. The filter according to claim 6, wherein the number of the plurality of resonators is an odd number.

10. The filter according to claim 6, wherein:

each of the plurality of resonators is formed by a pair of the broad walls and a narrow wall that resides between the pair of broad walls;

the pair of broad walls are constituted by a pair of conductor layers provided on opposite surfaces of a dielectric substrate; and the narrow wall passes through the dielectric substrate and is constituted by a conductor post group via which the pair of broad walls are in electrical communication with each other.

11. The filter according to claim 6, wherein at least one resonator of the plurality of resonators further includes a projection made of a conductor, the projection projecting inward from one of a pair of the broad walls that form the at least one resonator.

* * * * *